US007130437B2

(12) United States Patent
Stonikas et al.

(10) Patent No.: US 7,130,437 B2
(45) **Date of Patent: *Oct. 31, 2006**

(54) COMPRESSIBLE HEARING AID

(75) Inventors: Paul R. Stonikas, Darien, IL (US); Steven C. Hannibal, Buffalo Grove, IL (US); Gregory Prutnikov, Niles, IL (US); Roman Klyachman, Des Plaines, IL (US); Manolo J. Blancaflor, Des Plaines, IL (US)

(73) Assignee: Beltone Electronics Corporation, Chicago, IL (US)

( * ) Notice: Subject to any disclaimer, the term of this patent is extended or adjusted under 35 U.S.C. 154(b) by 752 days.

This patent is subject to a terminal disclaimer.

(21) Appl. No.: 09/892,137

(22) Filed: Jun. 26, 2001

(65) Prior Publication Data

US 2002/0025055 A1 Feb. 28, 2002

Related U.S. Application Data

(60) Provisional application No. 60/215,001, filed on Jun. 29, 2000.

(51) Int. Cl.
*H04R 25/00* (2006.01)

(52) U.S. Cl. ..... 381/322; 381/324; 381/328

(58) Field of Classification Search ..... 381/322, 381/324, 325, 328, 380; 181/129–130, 135
See application file for complete search history.

(56) References Cited

U.S. PATENT DOCUMENTS

| | | | |
|---|---|---|---|
| 789,876 | A | 5/1905 | Pape |
| 1,830,198 | A | 11/1931 | French |
| 2,441,866 | A | 5/1948 | Cantor |
| 2,446,707 | A | 8/1948 | Leight |
| 2,521,414 | A | 9/1950 | Schier |
| 2,535,258 | A | 12/1950 | Bland |
| 2,908,343 | A | 10/1959 | Hummert |
| 3,345,737 | A | 10/1967 | Gordon |
| 3,527,901 | A | 9/1970 | Geib |

(Continued)

FOREIGN PATENT DOCUMENTS

| | | |
|---|---|---|
| DE | G 1779936 | 10/1959 |

(Continued)

OTHER PUBLICATIONS

Krogh et al., "Various Types of Earmolds . . . ", Hearing Aid Fitting, 13th Danavox Symposium, 1988, pp. 429,437.

*Primary Examiner*—Suhan Ni
(74) *Attorney, Agent, or Firm*—Welsh & Katz, Ltd.

(57) ABSTRACT

A compressible hearing aid includes an exterior deformable skin which bounds an internal region which is filled, at least in part, with an open-cell foam, the foam can be wrapped around or molded to contain an audio output transducer. The skin is not self-supporting and in response to applied forces from user's ear canal, the skin and the foam both deform and readily compress exhibiting a reduced volume. Though compressed, the foam exerts an outward force against the skin thereby continuing to form an elongated seal between the skin and the external periphery of the user's dynamically changing ear canal. As the volume of the ear canal increases, the skin and open-cell foam expand, exhibiting an increased internal volume, while maintaining a comfortable seal with the ear canal. A plurality of external ribs carried on the skin not only reduces feedback but promotes drying of the ear canal and promotes retention of the hearing aid in the ear canal.

26 Claims, 38 Drawing Sheets

U.S. PATENT DOCUMENTS

| | | | |
|---|---|---|---|
| 3,729,892 | A | 5/1973 | Aslund et al. |
| 3,783,201 | A | 1/1974 | Weiss et al. |
| 3,872,559 | A | 3/1975 | Leight |
| 3,890,474 | A | 6/1975 | Glicksberg |
| 4,133,984 | A | 1/1979 | Akiyama |
| 4,160,449 | A | 7/1979 | Wade |
| 4,375,016 | A | 2/1983 | Harada |
| 4,412,096 | A | 10/1983 | Edgerton et al. |
| 4,434,794 | A | 3/1984 | Leight |
| 4,520,236 | A | 5/1985 | Gauthier |
| 4,539,440 | A | 9/1985 | Sciarra |
| 4,579,112 | A | 4/1986 | Scott |
| 4,608,217 | A | 8/1986 | Csiki |
| 4,614,487 | A | 9/1986 | Csiki |
| 4,617,429 | A | 10/1986 | Bellafiore |
| 4,739,512 | A | 4/1988 | Hartl et al. |
| 4,741,344 | A | 5/1988 | Danby et al. |
| 4,756,312 | A | 7/1988 | Epley |
| 4,774,938 | A | 10/1988 | Leight |
| 4,791,819 | A | 12/1988 | Goschke et al. |
| 4,800,636 | A | 1/1989 | Topholm |
| 4,834,211 | A | 5/1989 | Bibby et al. |
| 4,834,927 | A | 5/1989 | Birkholz et al. |
| 4,869,339 | A | 9/1989 | Barton |
| 4,870,688 | A | 9/1989 | Voroba et al. |
| 4,871,502 | A | 10/1989 | LeBisch et al. |
| 4,880,076 | A | 11/1989 | Ahlberg et al. |
| 4,937,876 | A | 6/1990 | Biermans |
| 4,962,537 | A | 10/1990 | Basel et al. |
| 5,002,151 | A | 3/1991 | Oliveira et al. |
| 5,006,055 | A | 4/1991 | Lebisch et al. |
| 5,008,058 | A | 4/1991 | Henneberger et al. |
| 5,015,225 | A | 5/1991 | Hough et al. |
| 5,131,411 | A | 7/1992 | Casali et al. |
| 5,195,539 | A | 3/1993 | Dyrud et al. |
| 5,203,352 | A | 4/1993 | Gardner, Jr. |
| 5,321,757 | A | 6/1994 | Woodfill, Jr. |
| 5,333,622 | A | 8/1994 | Casali et al. |
| 5,343,532 | A | 8/1994 | Shugart, III |
| 5,396,563 | A | 3/1995 | Yoshimi |
| 5,420,930 | A | 5/1995 | Shugart, III |
| 5,452,731 | A | 9/1995 | Dickman |
| 5,467,775 | A | 11/1995 | Callahan et al. |
| 5,530,763 | A | 6/1996 | Aebi et al. |
| 5,573,015 | A | 11/1996 | Williams |
| 5,609,164 | A | 3/1997 | Dyrud et al. |
| 5,622,662 | A | 4/1997 | Veiga et al. |
| 5,630,844 | A | 5/1997 | Dogan et al. |
| 5,631,965 | A | 5/1997 | Chang et al. |
| 5,654,530 | A | 8/1997 | Sauer et al. |
| 5,742,692 | A | 4/1998 | Garcia et al. |
| 5,799,658 | A | 9/1998 | Falco |
| 5,881,159 | A | 3/1999 | Aceti et al. |
| 5,904,143 | A | 5/1999 | Magidson et al. |
| 5,920,636 | A | 7/1999 | Oliveira et al. |
| 5,979,451 | A | 11/1999 | Leight |
| 6,022,311 | A | 2/2000 | Juneau et al. |
| 6,041,129 | A | 3/2000 | Adelman |
| 6,129,175 | A | 10/2000 | Tutor et al. |
| 6,228,020 | B1 | 5/2001 | Juneau et al. |
| 6,249,587 | B1 | 6/2001 | Clavadetscher et al. |

FOREIGN PATENT DOCUMENTS

| | | |
|---|---|---|
| DE | A 1231304 | 12/1966 |
| DE | G 79 29 224.3 | 10/1979 |
| DE | G 79 29 226.5 | 10/1979 |
| GB | 2 203 379 A | 10/1988 |
| JP | 61-238198 | 10/1986 |
| JP | 9-65493 | 3/1997 |
| JP | 9-65494 | 3/1997 |
| JP | 10/145896 | 5/1998 |
| WO | WO 93/25053 | 5/1992 |
| WO | WO 99/31934 | 12/1997 |
| WO | WO 99/31935 | 12/1997 |
| WO | WO 00/70911 | 5/1999 |

COMPRESSIBLE HEARING AID

This application claims the benefit of the filing date of an earlier filed Provisional Application Ser. No. 60/215,001, filed Jun. 29, 2000.

FIELD OF THE INVENTION

The invention pertains to hearing aids. More particularly, the invention pertains to hearing aids with deformable plastic housings that have variable internal volumes.

BACKGROUND OF THE INVENTION

Hearing aid housings have long been molded using acrylic resins which when cured are rigid, and hard. These housings often require extensive after the fact adjusting in response to user complaints of poor fit and/or poor performance. Complaints with this type of housing substantially increase overall production costs. Each unsatisfactory hearing aid must be reworked, replaced or the charge refunded to the user.

One of the disadvantages of rigid shell aids is that they are non-compliant and may force the user's ear canal to assume an unnatural shape in the cartilaginous region of the canal in order to achieve a seal. This in time can cause user discomfort and discourage usage of the aid.

It has now been recognized that dynamic changes in the shape of a user's ear canal as the user talks, breaths or swallows produce a situation where a rigid hearing aid housing conforms to the shape of the user's ear canal in only one state. This is the state the ear canal was in when an ear impression was taken. All other states will produce an uncomfortable fit or one that does not seal properly thereby producing feedback. Some of these issues have been addressed in a publication, *CIC Handbook,* Chasin, Singular Publishing Group, Inc., San Diego, 1997, pg 1–55.

A variety of solutions have addressed the fitting problem. One solution is disclosed in Yoest Patent No. 6,167,141, based on Ser. No. 09/070,124 filed Apr. 30, 1998, assigned to the assignee hereof and incorporated herein by reference. In Yoest, protrusions on a compliant body contribute to a comfortable seal with the respective ear canal.

Another prior solution combined deformable ear tips with rigid standardized housings that are to be inserted into the tips. These solutions rely on the deformable tips to compensate for differences between the user's ear canal and the shape of the housing contained within the tip.

The ear tip solution has had only limited success The thickness of the tip relative to the size of the ear canal and the size of the housing carried therein have resulted in a structure which has limited bendability when inserted into or removed from the ear canal. Thus, this solution can not be used with convoluted ear canals.

Another attempted solution uses a solid elastomeric housing which carries the audio processing circuitry and the battery. Elastomers, when cured, while solid are soft and deformable.

Known solid elastomeric housings, while deformable, are substantially incompressible. Such housings exhibit a substantially constant volume. This results in a situation where portions of the ear canal may push against portions of the elastomeric housing, deforming same. However the elastomeric material pushes back against the adjacent periphery of the ear canal, since it is substantially incompressible. This process is known to produce ear pain at times. This will come about if part of the elastomeric material is adjacent to soft tissue in the ear canal.

Solid elastomeric housings require balancing softness of material with strength. Softer elastomers have lower tensile strengths and tend to rip where they are thin. While exhibiting softness, solid elastomeric housings must still have enough strength to protect internal electrical/electronic components.

It has also been known to combine a gas containing bladder with a housing for a hearing aid. The bladder is deformable and compressible. The bladder is filed with a fluid such as ambient air.

The bladder can be filled before or after insertion. When the ear canal applies compression force to the bladder, the fluid therein will also be compressed. This compression in turn will increase the pressure applied by the fluid to the interior of the bladder, and the adjacent tissue of the user's ear canal.

For a constant temperature, reducing bladder volume by 50% produces a corresponding increase in expansion pressure within the bladder and ultimately, an increased force is applied to the ear canal. This becomes uncomfortable and unacceptable to the users.

In another attempted solution, a hollow deformable hearing aid housing has been formed of a semi-rigid material with thick enough side walls to be insertable into an ear canal without buckling. One known hearing aid with a housing as described above has been publicly marketed in the U.S.A. since 1996. In this hearing aid, the internal components, such as the output transducer, a receiver, were positioned in a gas filled interior. For example, the internal volume could be filled with ambient air.

When the housing is deformed, ambient air therein is forced from the interior. This solution provides only limited flexibility in the housing, due to the thickness of the housing. Insertion rigidity is achieved with this hearing aid as a result of the thickness of the housing. Beyond the limited flexibility, no protection was provided for the receiver and other electronic components. Hence, it was possible to easily damage these components. Finally, except for the tendency of the material to return to its initial shape, the memory of the molded housing, the housing, which was relatively thick, incorporated no force applying structure which tended to force it outward when inserted in the ear canal to provide a feedback reducing seal with the canal.

There continues to be a need for more comfortable hearing aids. Since ear canals are known to change shape and volume in response to jaw movement, it would be preferable if such changes could be responded to dynamically. In addition to comfort, there continues to be a need for hearing aids which effectively seal with the respective ear canal. It would be desirable to provide such improved functionality in either custom or standard sizes of hearing aids.

SUMMARY OF THE INVENTION

A deformable hearing aid housing has a pliable exterior plastic skin or sheath. The skin bounds, at least in part, an interior volume. The skin is very deformable and has a non-porous, solid exterior periphery. The periphery can be smooth or can exhibit one or more outwardly extending ridges or protrusions.

The skin is relatively thin, and buckles readily in response to an applied axial force. In addition, it exhibits very limited restoration forces when deformed. The skin can be formed of silicone, polyurethane, latex, polyvinyl chloride or other plastics. Thin thermoplastic sheet can be formed into skins of an appropriate shape.

An open cell-type matrix, such as an open cell foam, can be positioned inside the skin in the interior volume. The matrix is positioned, at least in part, in contact with an interior periphery of the skin and occupies a portion of the interior volume of the skin. The matrix applies an outwardly directed restoring force to the skin. This pre-loading or restoring force tends to cause the skin to exhibit a fully expanded state if no external compressing forces are applied. The matrix need not exert very much pre-loading force since the skin is thin and very compliant.

When the skin is deformed by an externally applied deformation force, for example such as due to insertion in an ear canal, both the skin and the internal matrix collapse in response to that force. Thereupon, some of the ambient atmosphere contained in the skin is forced from the interior volume of the skin. This produces a reduced interior volume.

Since the reduced volume has been achieved by expulsion of internal ambient air, the magnitudes of the outwardly oriented shape restoring forces do not significantly increase. When the external deformation force is removed, the skin attempts to return to its original shape in response to the restoring forces applied by the matrix. The present invention enables the respective hearing aid to be compressed over a larger range of volume changes than heretofore possible without creating uncomfortably high pressures in the respective ear canal.

When the housing is inserted into a user's ear canal, the skin will collapse and deform in response to the shape of the user's canal. This will in turn compress the internal matrix and force some of the ambient air therein from the housing resulting in a reduced internal volume. As the housing slides through the bends in the ear canal, it will deflect in accordance therewith.

When the housing is fully inserted into the user's canal, the internal matrix will apply expansion forces to the internal periphery causing the skin to expand and fill the adjacent volume of the ear canal The interaction between the interior periphery of the ear canal and the exterior periphery of the skin will produce an elongated, convoluted feedback minimizing seal therebetween. The matrix tends to apply pressure evenly to the compliant elastomeric skin which in turn presses against the respective ear canal.

Subsequently, when the user talks, eats or breathes, and in the process changes the shape and/or volume of the ear canal, the housing will deform in accordance therewith. Its volume can increase and decrease in accordance with the changes in shape of the canal. The interior matrix continuously maintains an externally directed restorative force to mold the exterior periphery of the skin to the adjacent exterior periphery of the user's ear canal.

While the matrix continually attempts to expand the skin or sheath, it decompresses in accordance with its own physical characteristics. Hence, as the ear canal changes shape and/or volume, the response time of the matrix can result in short intervals where portions of the elongated seal with the canal may be broken. This provides a transient opportunity for air flow in/out of the canal which should contribute to both user comfort and health.

The reformation force of the skin alone is not sufficient to seal with the ear canal so as to block the passage of sound between the exterior of the skin and the ear canal. The compressible matrix creates enough outwardly directed reformation forces to provide an elongated seal with the ear canal, over a substantial portion of the length of the skin in the canal. This seal blocks the passage of sound. Hence, the sound will be unable to travel unabated through the canal, along the exterior of the skin, to the outer ear end of the aid and into the microphone thereby causing feedback.

In one embodiment the elastomeric skin can have a thickness on the order of less than 50 thousandths of an inch. The skin can exhibit a hardness parameter in a range of 4–40 Shore A. The internal matrix can exhibit a hardness parameter on the order of less than twenty Shore A.

In one aspect, to insure that the elastomeric skin will conform to the shape of the respective ear canal when volume of the canal increases, the skin can be pre-loaded by the foam matrix creating a tendency to expand. The foam matrix is as a result, slightly compressed when in the skin.

In a further aspect, the skin can be formed of a strong, tear resistant plastic. Since the skin is very compliant, size and shape are less critical than is the case with rigid shells.

The matrix can be tailored to improve user comfort. The respective hearing aid can exhibit multiple zones of softness, stiffness and compressibility. In some regions, compressibility can be maximized. In other regions, more rigidity can be provided to assist insertion. Additionally, the matrix and the matrix/skin interface absorb unwanted transient energy or vibrations in the hearing aid. Alternately, multiple foams with different characteristics can be used in a single skin.

The foam minimizes shock to the internal electronics. The preferred foam is a slow recovery foam which resists dynamic fatigue and compression set.

Open or closed cell foams can be used depending on desired characteristics. For example, recovery rate can be altered by selection of foam with a slower recovery rate, for example. With such foams, the time that the seal between the skin and the respective ear canal is broken can be increased. This may promote air flow and drying in the canal.

A layered structure can be used to absorb and reflect unwanted mechanical energy from the output transducer, the receiver. A layered structure, skin and matrix, decouples unwanted vibration al energy from the exterior surface of the skin. This enables the use of higher output power without undesired feedback.

In another aspect, the exterior periphery of the skin can carry a plurality of integrally molded, relatively short, outwardly oriented ribs. these ribs, after insertion, directly contact the periphery of the ear canal. They tend to attenuate acoustic energy which is internally generated and is radiating outward toward the ear canal. This reduces feedback enabling the respective hearing aid to be operated at a higher gain than previously possible.

The ribs also provide spaces between the ear canal and the deformable housing. these spaces facilitate drying of the user's ear canal. They also assist in holding the housing in place.

An electronic module can be attached to the skin, at a standardized modular opening, using an adhesive such as rubberized cyanoacrylate alone or in combination with silicone RTV-type adhesive.

Since the skin is very compliant, axial rigidity is provided to facilitate insertion. In one embodiment, at least one semi-rigid vent tube, or, spine can be used to provide stiffness for insertion. The vent tube extends axially along the interior periphery of the skin. It can be integrally molded into, glued to or welded to the skin at one or more regions along its length. It thus provides venting and stiffening functions. One or more ribs or spines an be used.

In yet another embodiment, an ultra-thin skin can be formed of one to three thousandths thick thermoformed thermoplastic sheet stock, or, injection molded thermoplastic. A plurality of standardized skins of different sizes can be formed of injection molded thermoplastic with a thickness on the order of ten thousandths of an inch.

Numerous other advantages and features of the present invention will become readily apparent from the following detailed description of the invention and the embodiments thereof, from the claims and from the accompanying drawings.

BRIEF DESCRIPTION OF THE DRAWINGS

FIG. 5A-1 is a sectional view as in FIG. 5 illustrating outflow of ambient atmosphere in response to applied exterior forces;

FIG. 5A-2 is a side sectional view illustrating inflow of ambient atmosphere in response to release of applied exterior forces;

FIG. 5A-3 is a side sectional view as in FIG. 5 without a vent tube, or spine, illustrating collapse in response to axial insertion forces;

FIG. 5A-4 is a side sectional view as in FIG. 5 with a vent tube illustrating resistance to axial insertion forces;

DETAILED DESCRIPTION OF THE PREFERRED EMBODIMENTS

Figure 1:
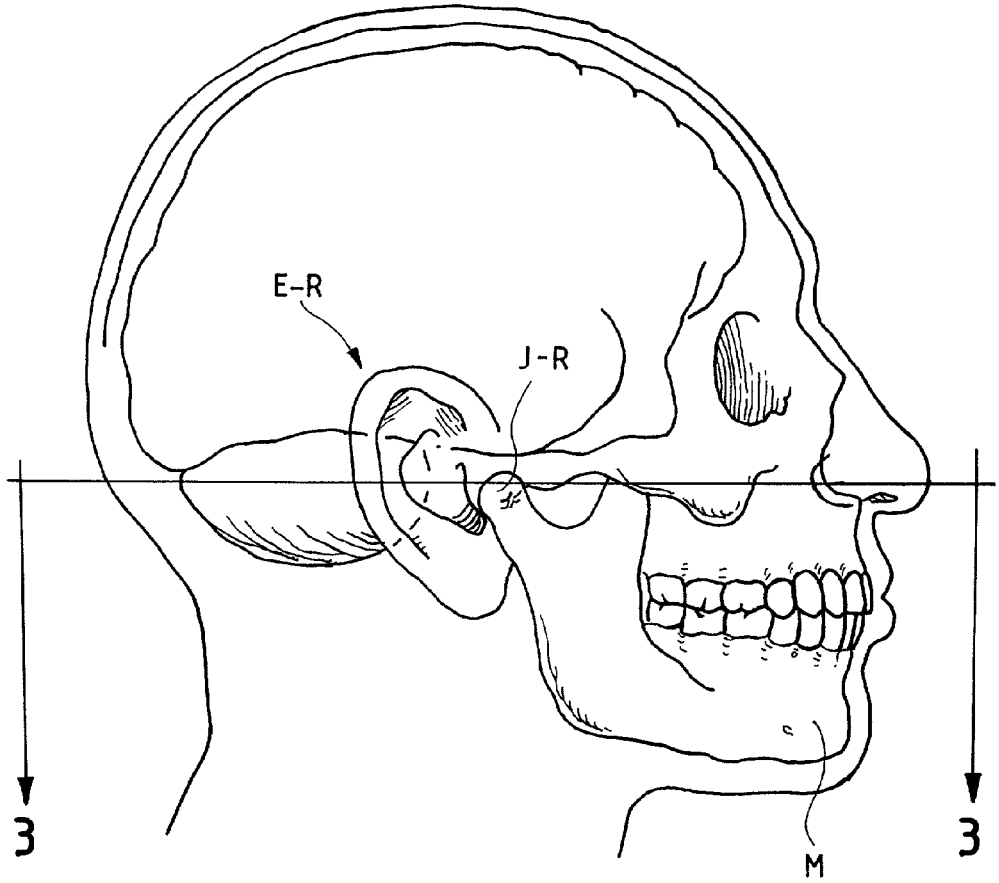
FIG. 1 is a side view of a human head illustrating selected anatomical features.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

FIGS. 1–4B illustrate several aspects of the human anatomy relevant to the hearing aid of the present invention. FIG. 1 is a side view of a human head with an ear E, mandible, jaw bone, M and temporomandibular joint J. FIG. 1 also illustrates the location of transverse section 3—3, discussed subsequently. It has now been recognized that movement of the mandible M while talking, eating, or breathing must be taken into account in the design and fitting of hearing aids.

Figure 2B:
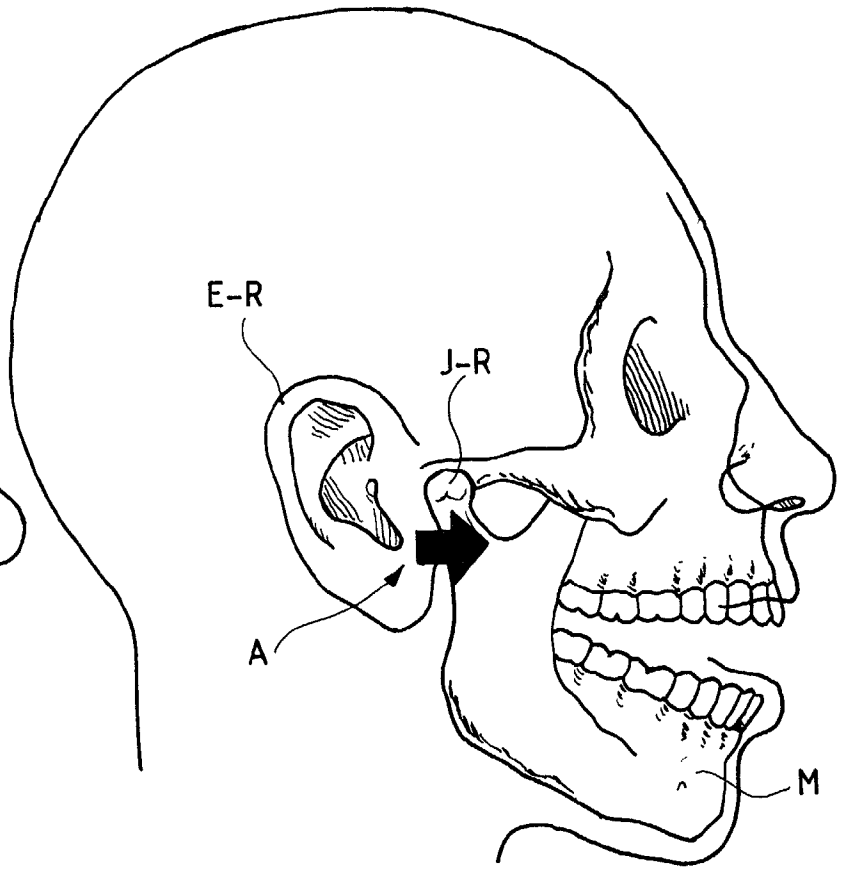
Figure 2A:
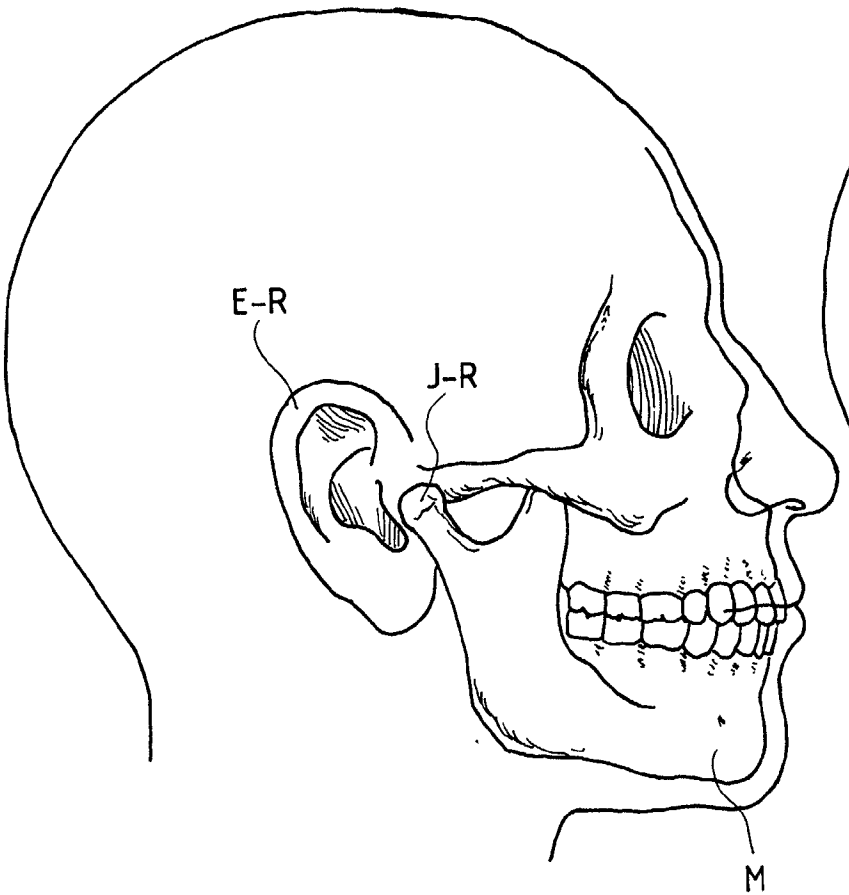
FIGS. 2A,B together illustrate anatomical features as the mandible opens and closes.

FIGS. 2A,2B illustrate relative positions of the mandible M relative to ear E in a closed, FIG. 2A, position and in an open, FIG. 2B position. Mandible M both translates, arrow A and rotates when going from the closed to the open position. When mandible M recloses, the motions reverse.

Figure 3:
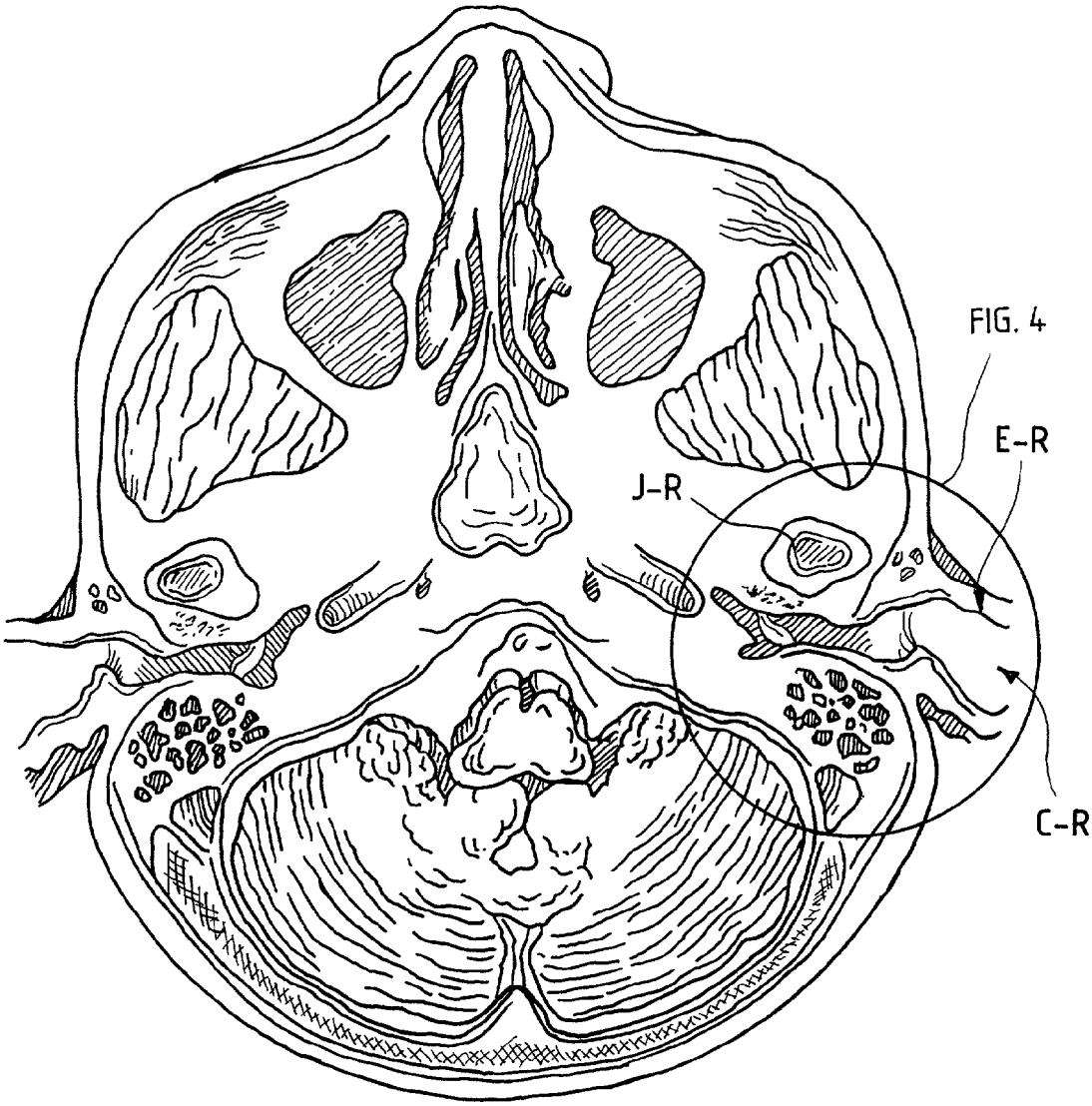
FIG. 3 is a section taken along plane 3—3 of FIG. 1.

FIG. 3 the section through plan 3—3 of FIG. 1 illustrates the relative positions of the left ear E-R, right ear E-R and the mandibular joints J-L, J-R. Associated with each of the ears is a respective, multi-bend ear canal C-L and C-R. The convoluted nature of ear canals, as illustrated in FIG. 3 imposes a requirement on any hearing aid, which is intended to extend even partly into the canal that it be flexible and soft enough to comfortably pass through both bends in the respective canal. In addition, the inserted aid must be canal friendly and not irritate or press against the canal in any way which will cause discomfort for the user. As noted above, there have been various prior attempts to address these requirements which have been only partly successful.

Figure 4:
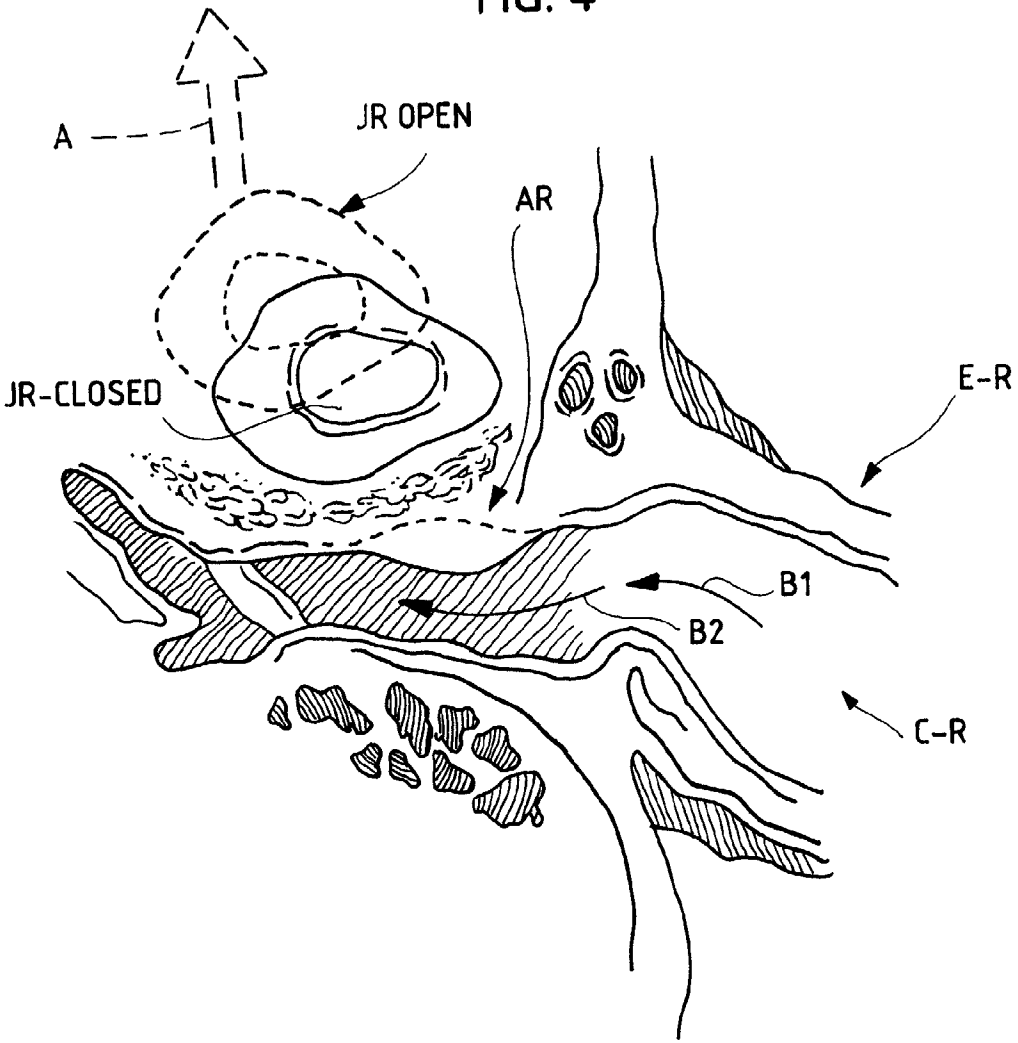
FIGS. 4 illustrates anatomical details of a human ear canal with closed and open mandibles.

FIG. 4 illustrates an enlarged section of FIG. 3 for the closed mandible and open mandible positions. The canal is bounded by cartilage in the vicinity of bend B1. A transitional region is present in the vicinity of bend B2. This region includes the end of the cartilage, the boundary to bend B1, an articulated region AR which moves in response to movement of the mandible M, and the beginning of the bony portion of the canal which extends to the tympanic membrane. Beyond the second bend B2 is the bony section of the canal. As illustrated in FIG. 4, while speaking or eating, as the mandible translates and rotates back and forth, the articulated region changes shape and goes from a smaller cross section, with mouth closed (illustrated in solid in FIG. 4) to a larger cross section, (illustrated in phantom, the region AR) and back again.

Figure 5:
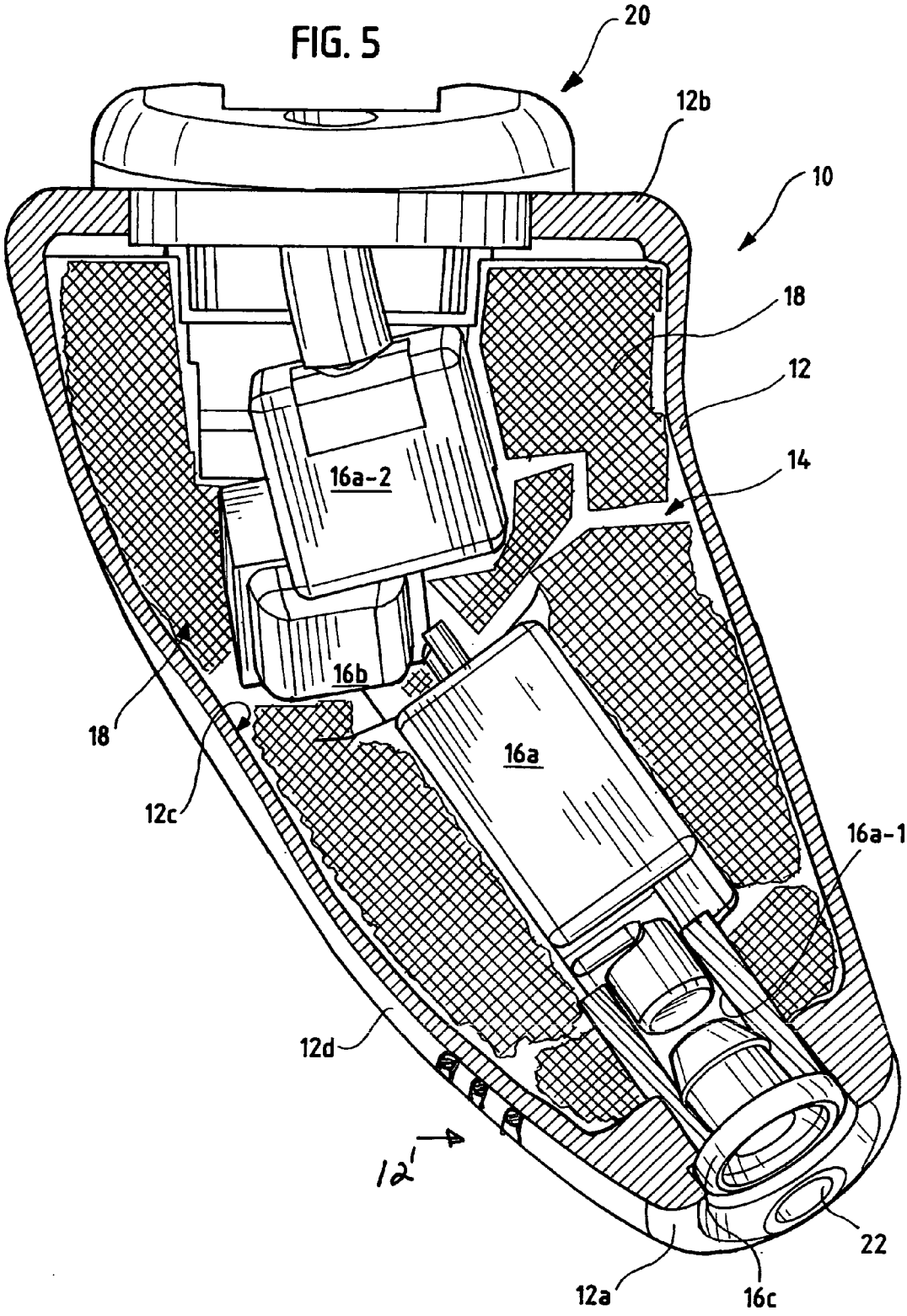
FIG. 5 is a side sectional view of a hearing aid in accordance with the present invention.

FIG. 5 illustrates a compressible hearing aid 10 which is insertable into the respective canal, such as canal C-R, past the bends B1 and B2 and into the bony section of the canal. In addition, the aid 10 is very soft and comfortable resides in the bony section of the canal. In the articulation region, the aid 10 decreases and increases in cross section in response to movement of mandible M and the respective joints J-R, J-L. Finally, aid 10 provides an elongated sealing region which dynamically follows the changes in canal cross section to maintain an acoustic seal and minimize feedback.

The aid 10 includes a thin, elastomeric skin or sheath 12 which exhibits little or no resistance to either axially or laterally applied forces. In one embodiment, for example the skin 12 can be so soft as to not be capable of supporting itself against the force of gravity. The skin 12 can optionally carry a plurality of outwardly oriented ribs 12'.

The skin 12 can have a thickness on the order of less than 50 thousands of an inch. Softness corresponds to a range on the order of 5 to 40 Shore A. The skin 12 is deformable and soft enough that it can not be inserted into the respective ear canal without being stiffened axially.

The skin 12 has a substantially closed canal end 12*a* and an open outer ear end 12*b*. The skin 12 bounds an interior region 14 which includes electronic components including a receiver 16*a* electrically coupled to processing circuitry 16*b* of a type which would be known to those of skill in the art. The audio output from receiver 16*a* is coupled to an output port 16*a*-1, which might include a wax guard 16*c*. A microphone 16*a*-2 receives audio signals incident on outer ear end 12*b* and converts same to an electrical input to circuitry 16*b*.

The region 14 is at least partly filled with a compressible matrix 18 which might be an open cell foam, a fabric or other compressible material. The foam can be in one or more pieces. The pieces of foam can be attached together with an elastomer.

The foam can be pre-cast in a desired shape. For example part of the foam can be cast in the shape of a receiver support. The receiver 16*a* can then be inserted therein during assembly.

Preferably, the skin 12 is not attached to matrix 18. As such, the skin can move relative to matrix 18 on insertion or in response to changes of shape of the ear canal. The skin has a nominal wall thickness 12*c* which could be on the order of one thousandth of an inch. A modular faceplate structure 20 which could include a battery compartment and microphone 16*a*-2 closes end 12*b*.

Faceplate 20 is attached to skin 12 by one or more of adhesive, heat sealing, fusing, mechanically, ultrasonic or radio frequency welding, or by any other process which will reliably couple the two elements together. Attachment details are not a limitation of the present invention.

Figures 1, 5A:
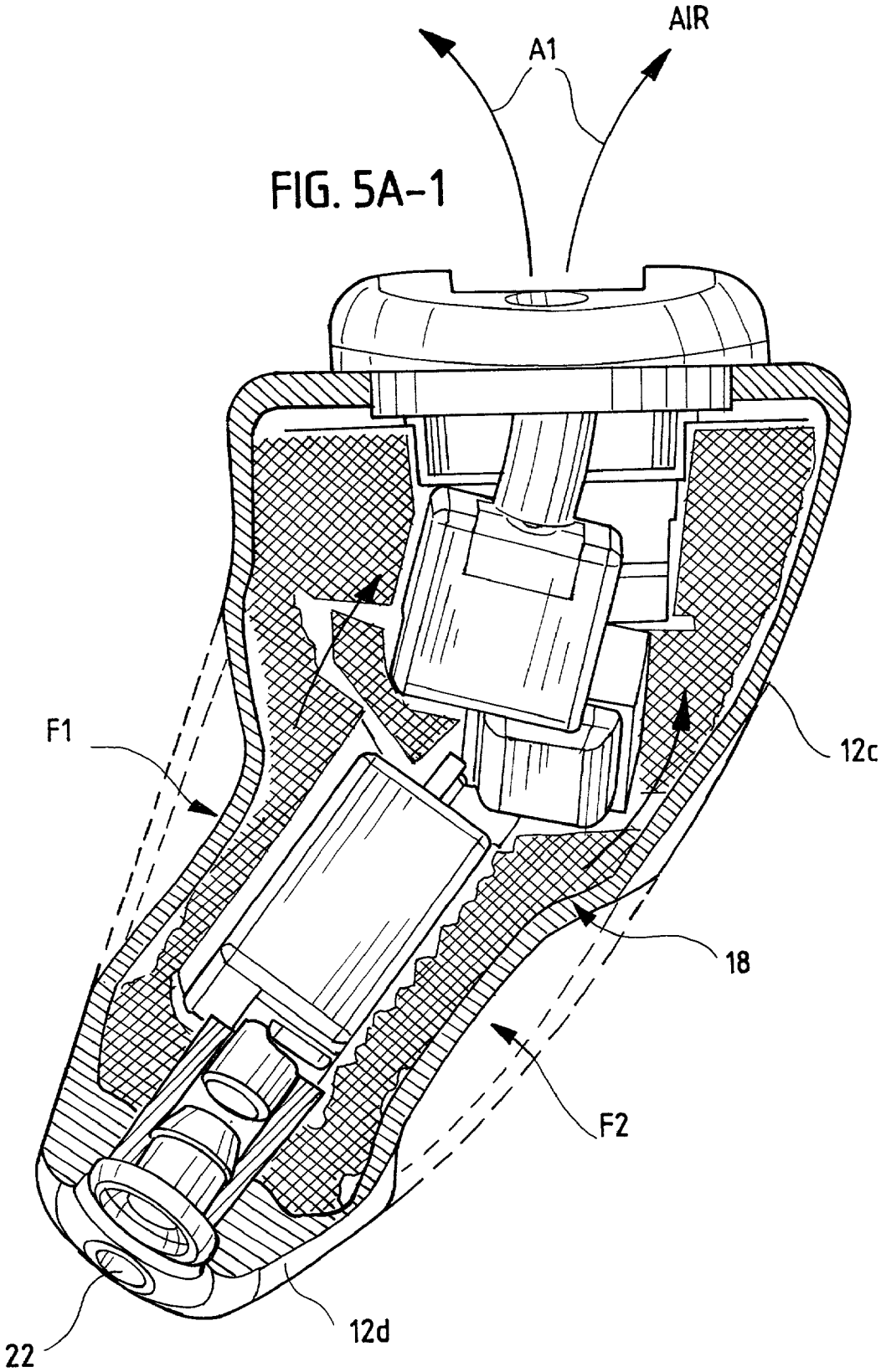
Figures 2, 5A:
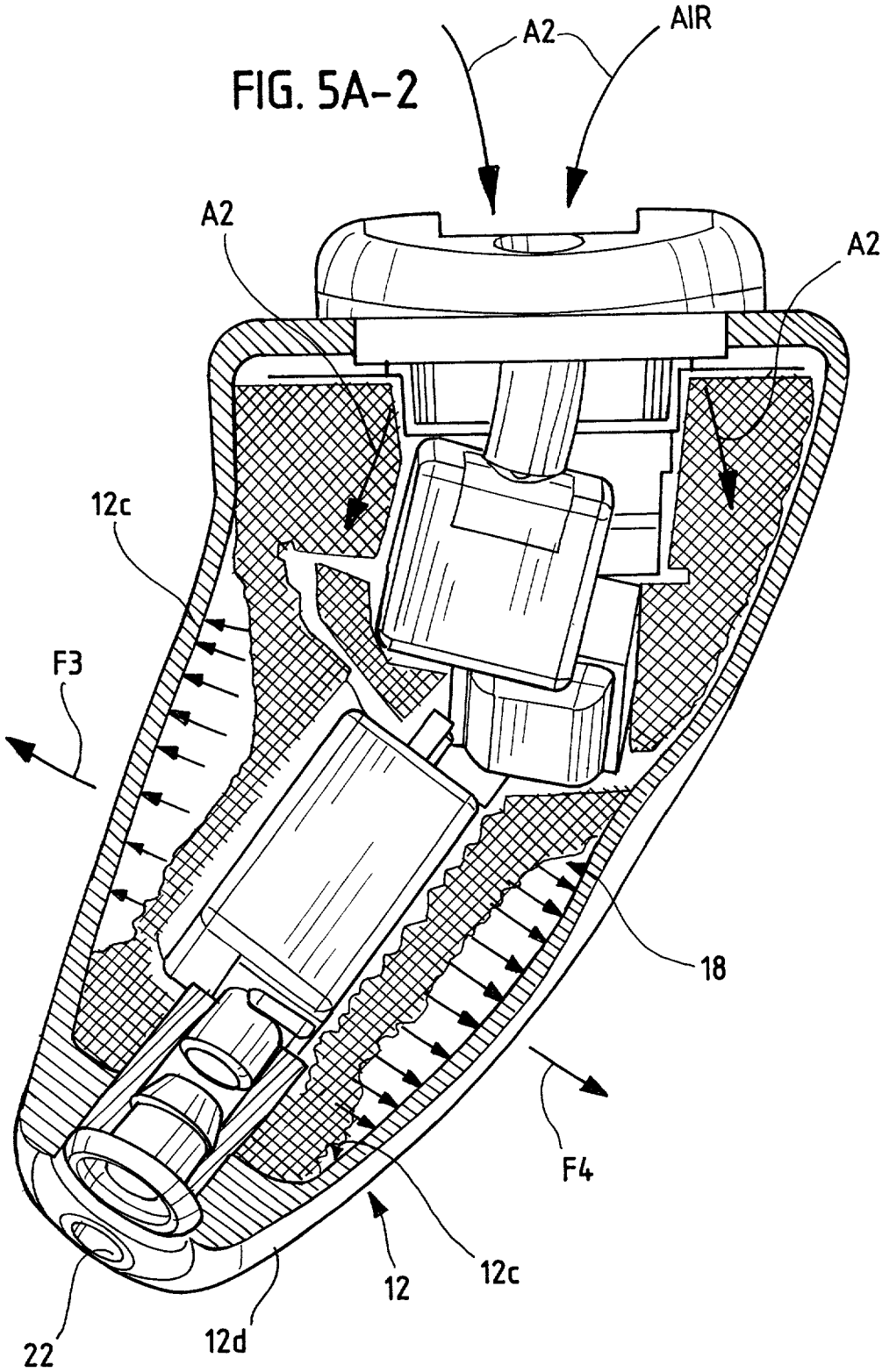
Figures 4, 5A:
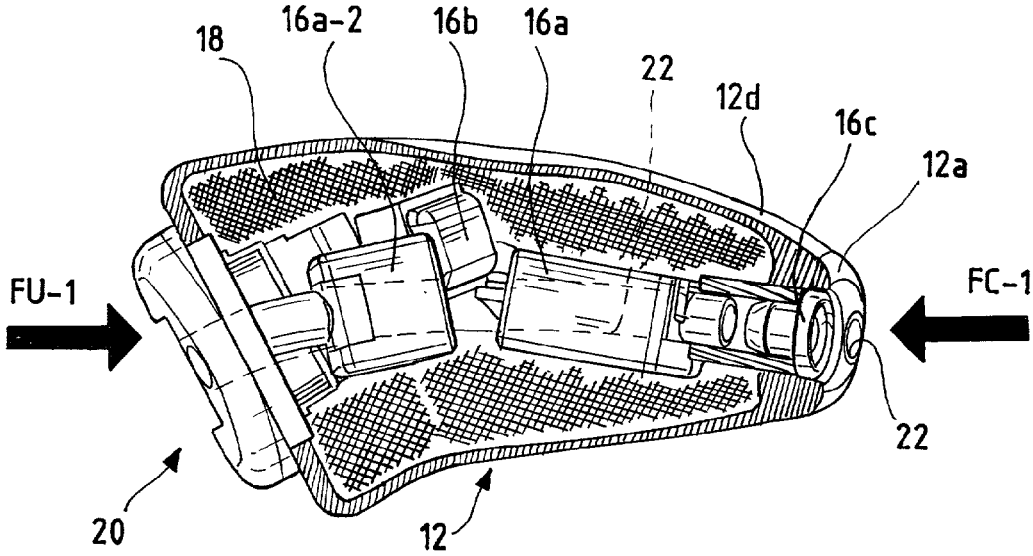
Figures 3, 5A:
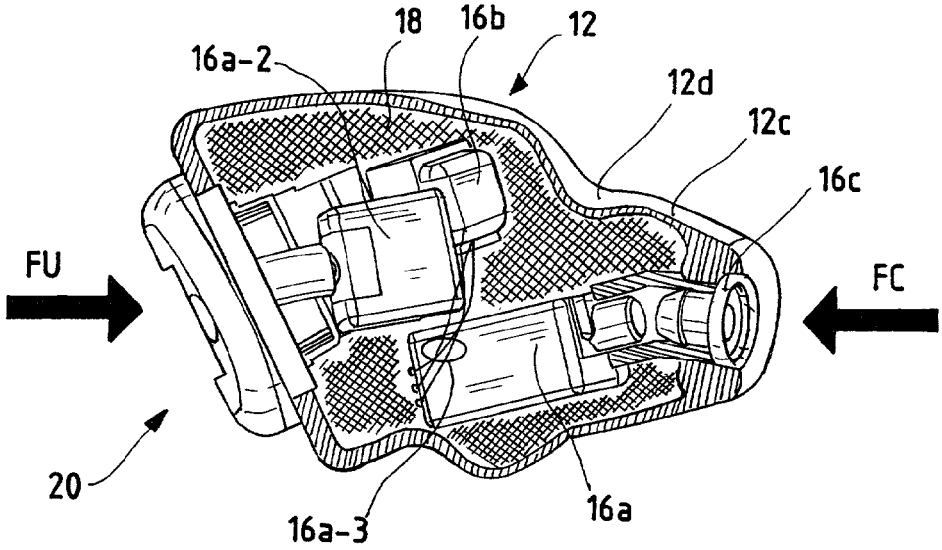

With respect to FIGS. 5A-1,-2, the matrix 18 is compressible such that air in the matrix can be expelled A-1 from within the sheath 12 on insertion and in response to forces F1, F2 due to movement of the mandible M, best seen in FIG. 5A-1. The matrix 18 continually imposes expansive forces, generally indicated as F3, F4 in FIG. 5A-2, on the skin 12 which create a seal between the exterior periphery 12*d* of the skin 12 and the adjacent ear canal. While easily deformable in response to movement of mandible M, the skin 12 is continually pushed against the canal by the matrix 18 to maintain this seal. As the skin 12 expands, air A2 flows back into the interior thereof.

The ability to compress the internal volume of skin 12 and expel air A1 therefrom is especially beneficial in that there is no substantial increase in restorative forces due to air trapped in shell 12. Inflowing air A2 contributes to resealing against the ear canal, discussed below.

Sealing takes place along the exterior periphery 12*d* of the skin 12 and is not limited to one particular part of the skin. This sealing characteristic is unlike the typical seal formed by a rigid shell aid where seals are usually formed in the cartilage of the ear canal, in the vicinity of the first bend.

Figure 5B:
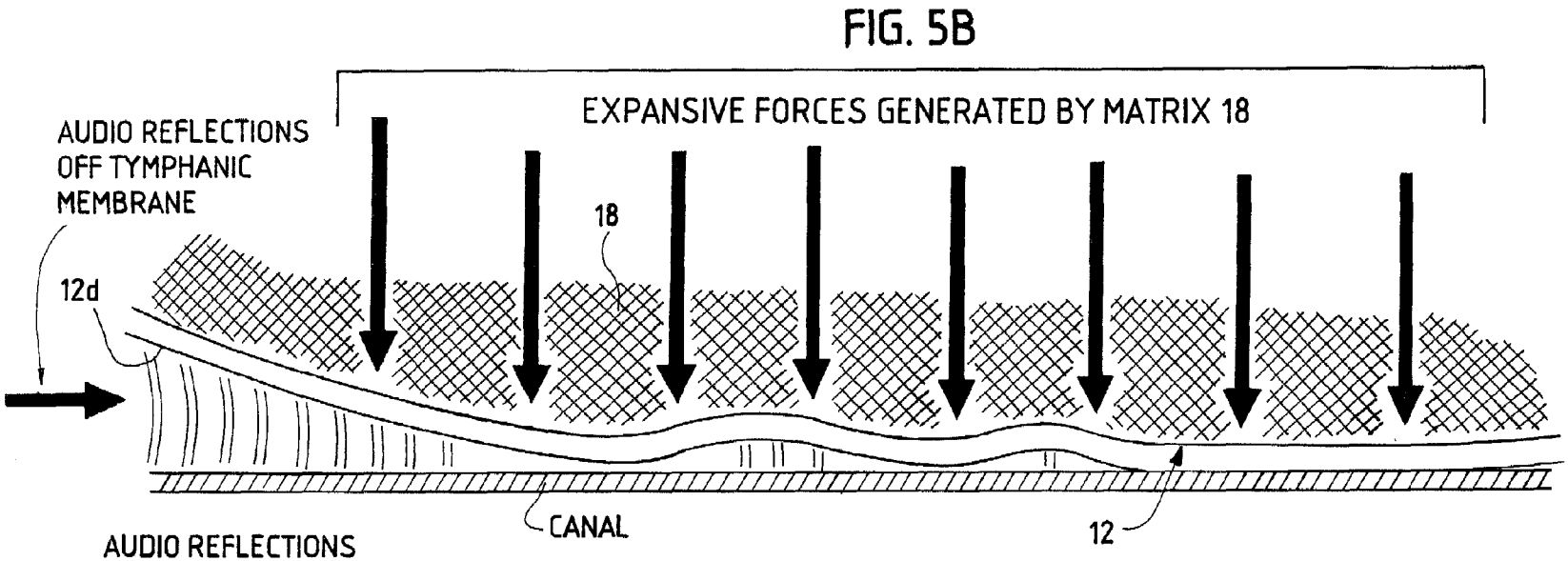
FIG. 5B is a side sectional view of a sheath in accordance with the present invention positioned in an ear canal and containing a compressible matrix in accordance with the present invention.

With respect to FIG. 5B, the elongated seal created by the expansive forces of the matrix 18 is effective to attenuate sound waves which have been initiated by receiver 16*a*. These waves are incident on the membrane and are then reflected off of that tympanic membrane back to the end 12*a*, see FIG. 5B. Attenuating these waves minimizes feedback problems.

Figure 5C:
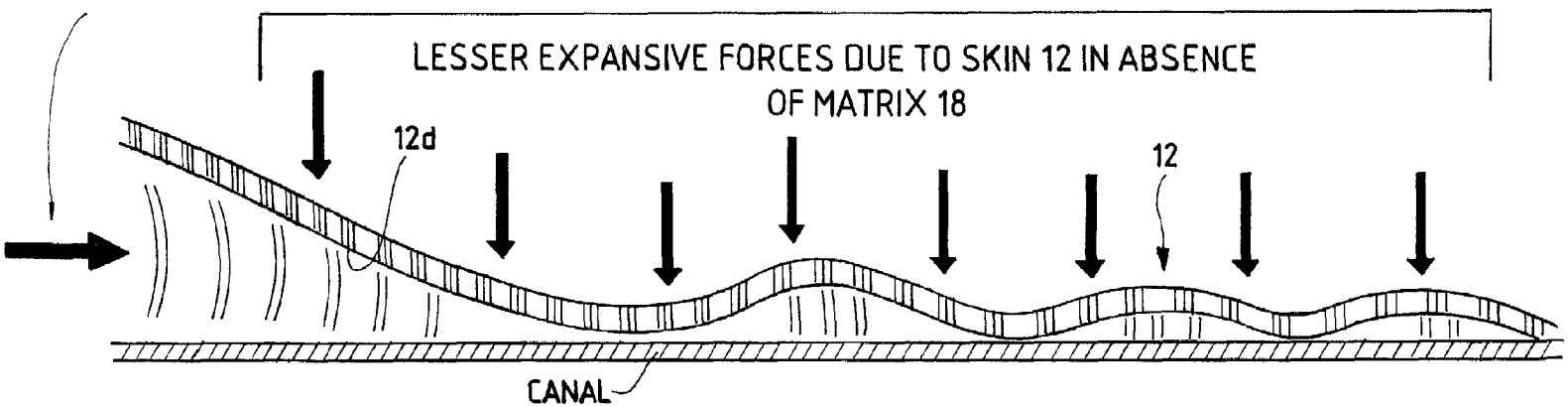
FIG. 5C is a sectional view of a sheath in accordance with the present invention positioned in an ear canal without an interior compressible matrix.
Figure 6:
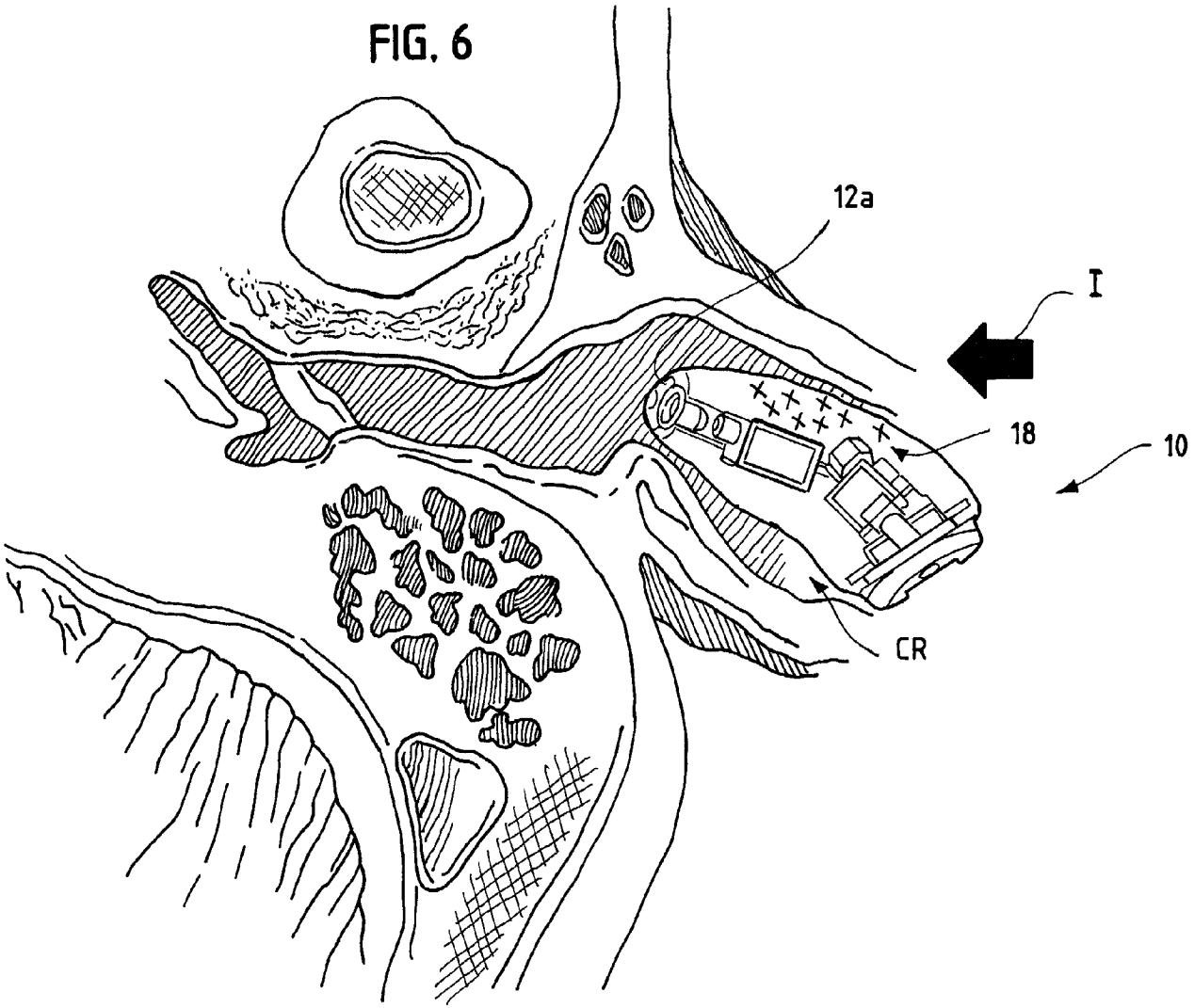
FIGS. 6–9 taken together illustrate details of insertion of the aid of FIG. 5 into an ear canal.
Figure 7:
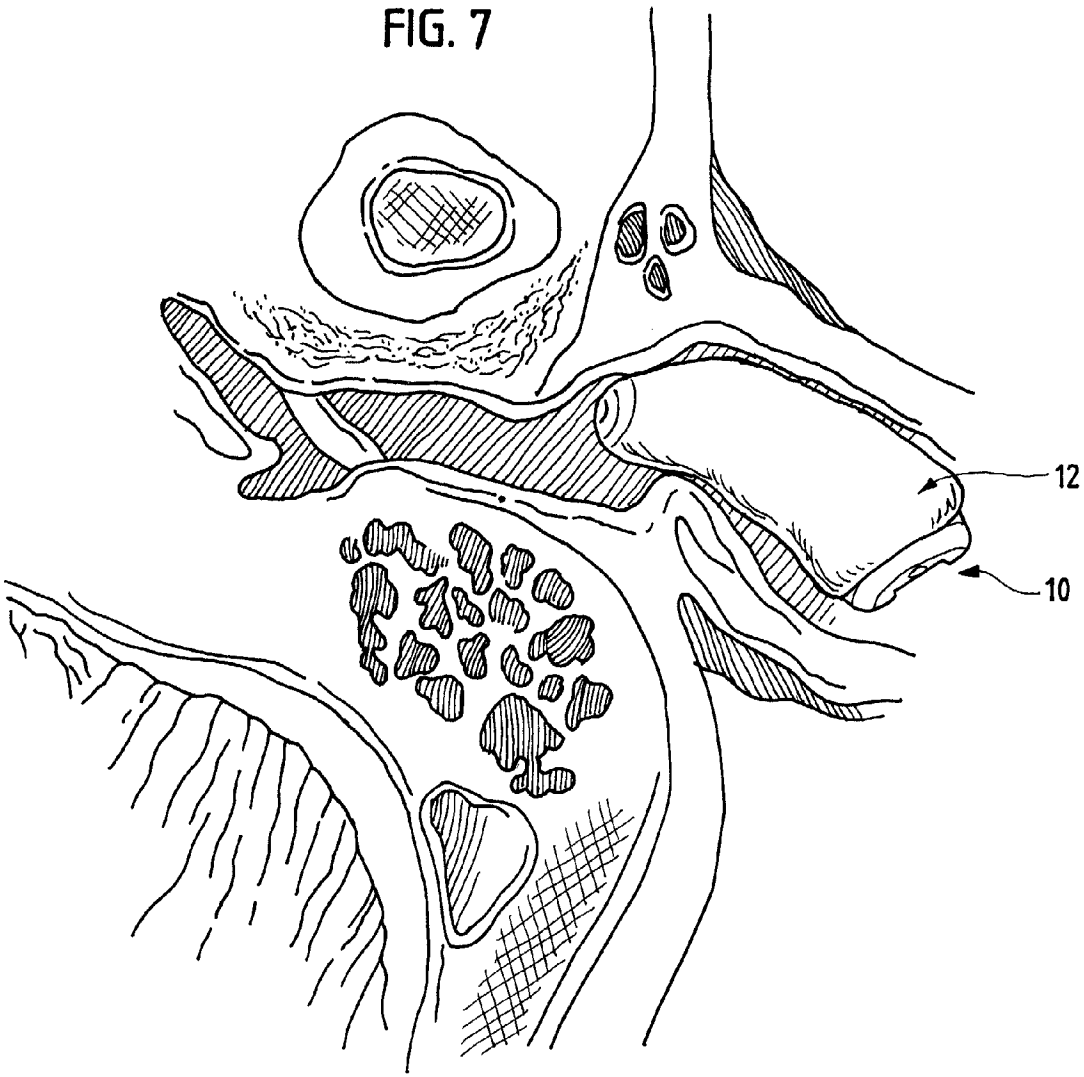

In the absence of these expansive forces, as illustrated in FIG. 5C, these acoustic waves are not attenuated or blocked to the same degree and can propagate, via slit leaks, between the wall of the canal and the exterior periphery 12*d* of the skin or sheath 12 to the outer ear end 12*b*. These waves can be detected by the respective microphone and amplified contributing to a feedback problem.

To provide axial stiffening forces, a spine 22 can be positioned in region 14 extending axially adjacent to interior surface 12*c*. The spine 22 can be bonded to skin 12 by ultrasonic welding, adhesive, heat or any other process. One or more spines can be molded into the interior of the skin. In a preferred embodiment, spine 22 can be implemented as a flexible vent tube.

Spine, vent tube, 22 is laterally flexible but provides axially directed forces which oppose canal generated distorting forces during insertion. As illustrated in FIG. 5A-3, when a user pushes on aid 10, force FU, to insert it into his or her ear canal, such as canal C-R, interaction with the canal generates a resistive force FC.

In the absence of spine or vent tube 22, hearing aid 10 will be difficult to insert into the ear canal. Soft shell 12 and matrix 18 deform causing receiver 16*a* to move toward modular faceplate 20 and abut microphone 16*a*-2, see FIG. 5A-3. This distorts the shape of skin 12 and stresses wiring 16*a*-3 between processing circuits 16*b* and the output transducer, receiver 16*a*. Hence, the shell 12, even in the presence of matrix 18 and internal components such as receiver 16*a* and processing circuits 16*b* readily deforms in the presence of forces FU, FC.

Unlike the circumstance of FIG. 5A-3, in FIG. 5A-4 the vent tube 22, shown in phantom behind receiver 16*a* and microphone 16*a*-2, provides axial stiffening forces which resist canal induced forces FC-1. On insertion, as the user slides aid 10 into his/her ear canal, C-R, via force FU-1, the vent tube 22 stiffens shell 12 axially thereby opposing resistive canal forces FC-1. The axial stiffness of the spine or vent tube 22 overcomes the deformability of the shell 12 and matrix 18 so that the aid 10 can be slid into position in the canal without the type of distortion and stress imposed on the structure as illustrated in FIG. 5A-3.

The vent tube 22 is soft, laterally deformable and bendable. Hence, vent tube 22 does not interfere with ease of insertion nor does it compromise collapsibility of matrix 18 and shell 12.

FIGS. 6–9 illustrate insertion of the aid 10 into a representative ear canal, such as C-R as in FIG. 4. The aid 10 is moved in direction I into the cartilaginous entrance to the canal, FIG. 6. As the end 12*a* of the skin 12 enters the first bend, B1, the skin 12 comes into contact with adjacent portions of the canal, FIG. 7. The shape of the canal, closed mandible, distorts and compresses the skin 12 and internal matrix 18.

Figure 8:
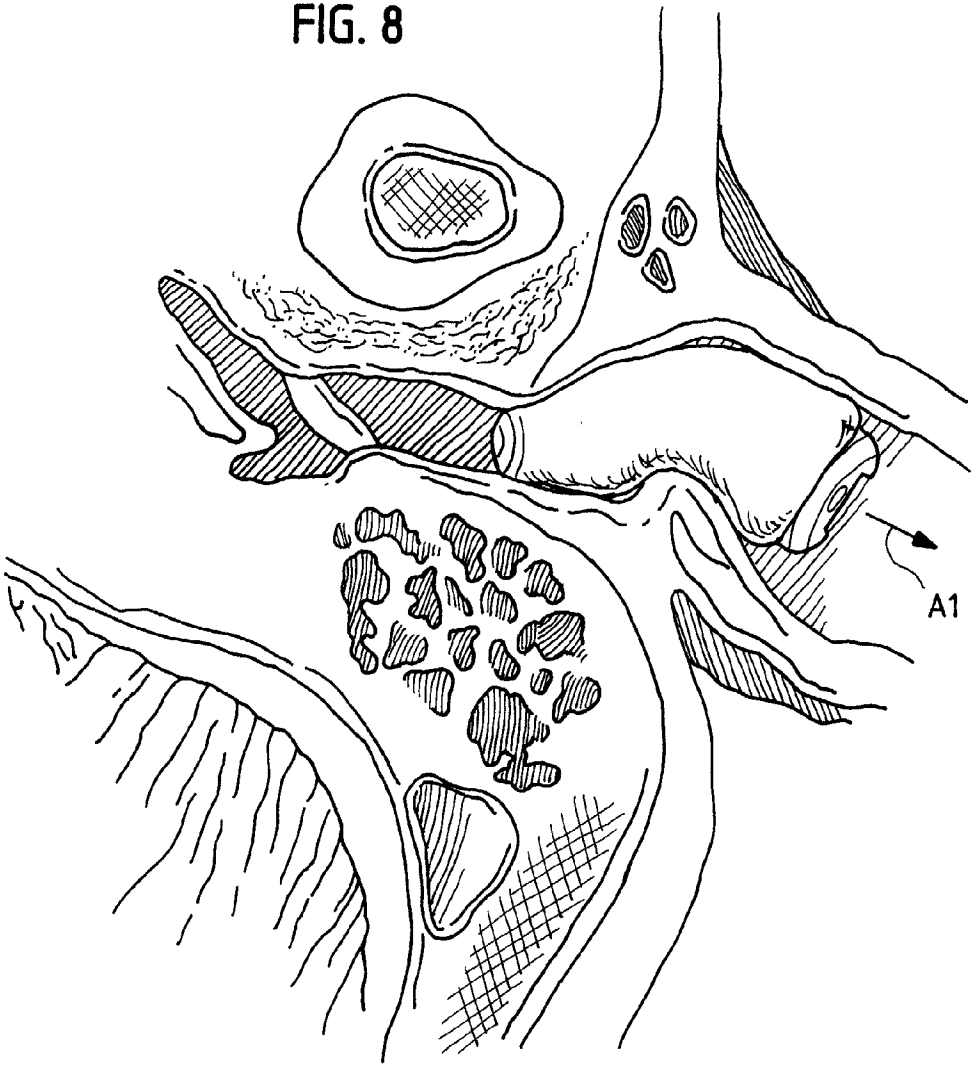

Air A1 in the matrix 18 and elsewhere in the region 14 is expelled from the skin 12 as the skin 12 and matrix 18 collapse due to forces applied in passing through bend B1, see FIG. 8. While the volume of the aid 10 decreases during this process, none of the electronic components, such as the receiver 16*a*, or processing circuitry 16*b* are distorted but they may be moved relative to one another from their uncompressed relative positions. The matrix 18 collapses but protects those components at the same time.

Figure 9:
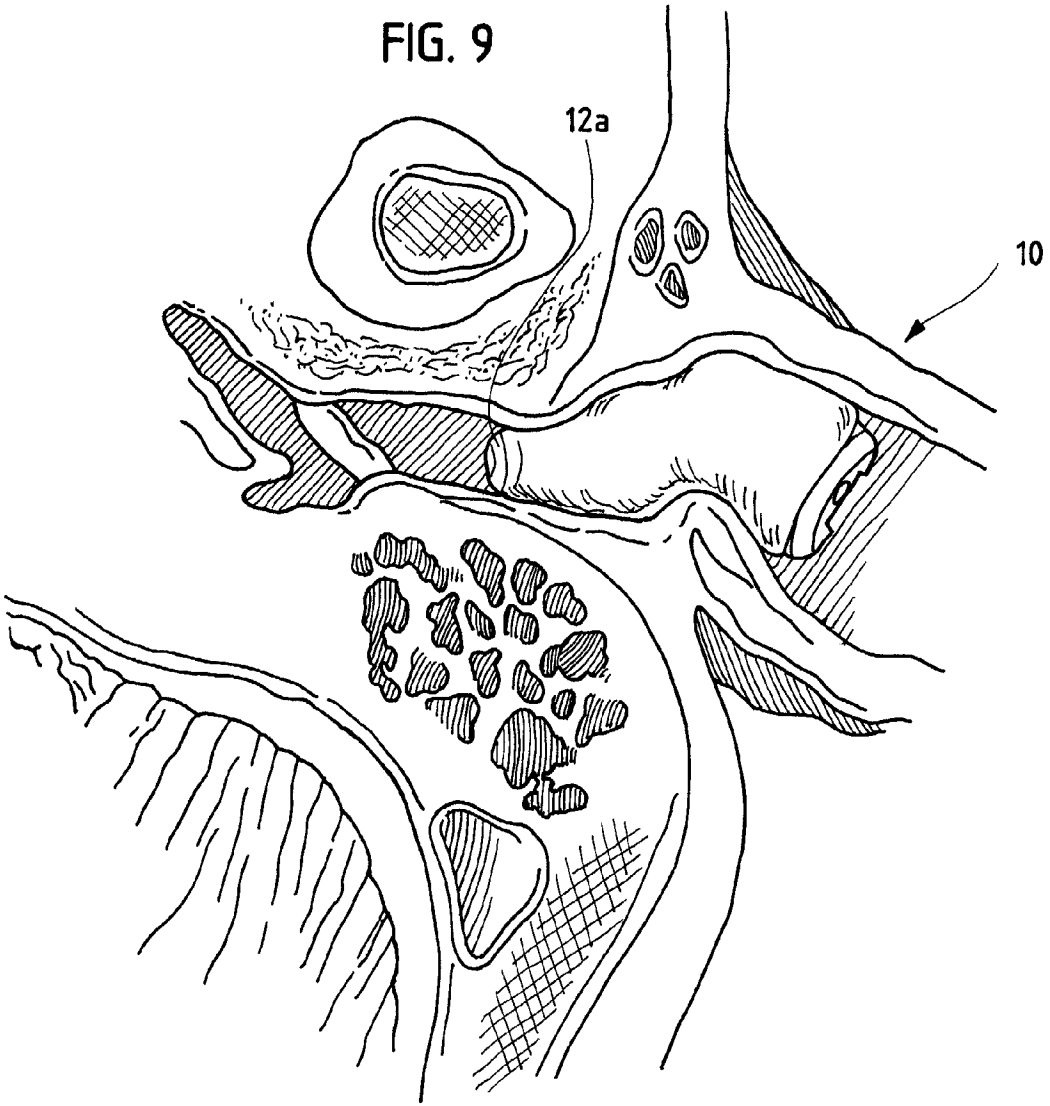

As the aid 10 is inserted into its final position, see FIG. 9, and passes through the second bend, B2, the shell 12 and matrix 18 continue to change shape in response to the forces applied by the canal. The soft and compressible structure of the aid 10 not only make insertion comfortable but the end

12*a* of the skin 12 is compatible with the physiological characteristics of the bony portion of the canal, in the vicinity of and past bend B2. Hence, users will not experience pain or discomfort due to contact with the thin layer of tissue in the bony portion of the canal.

Figure 10:
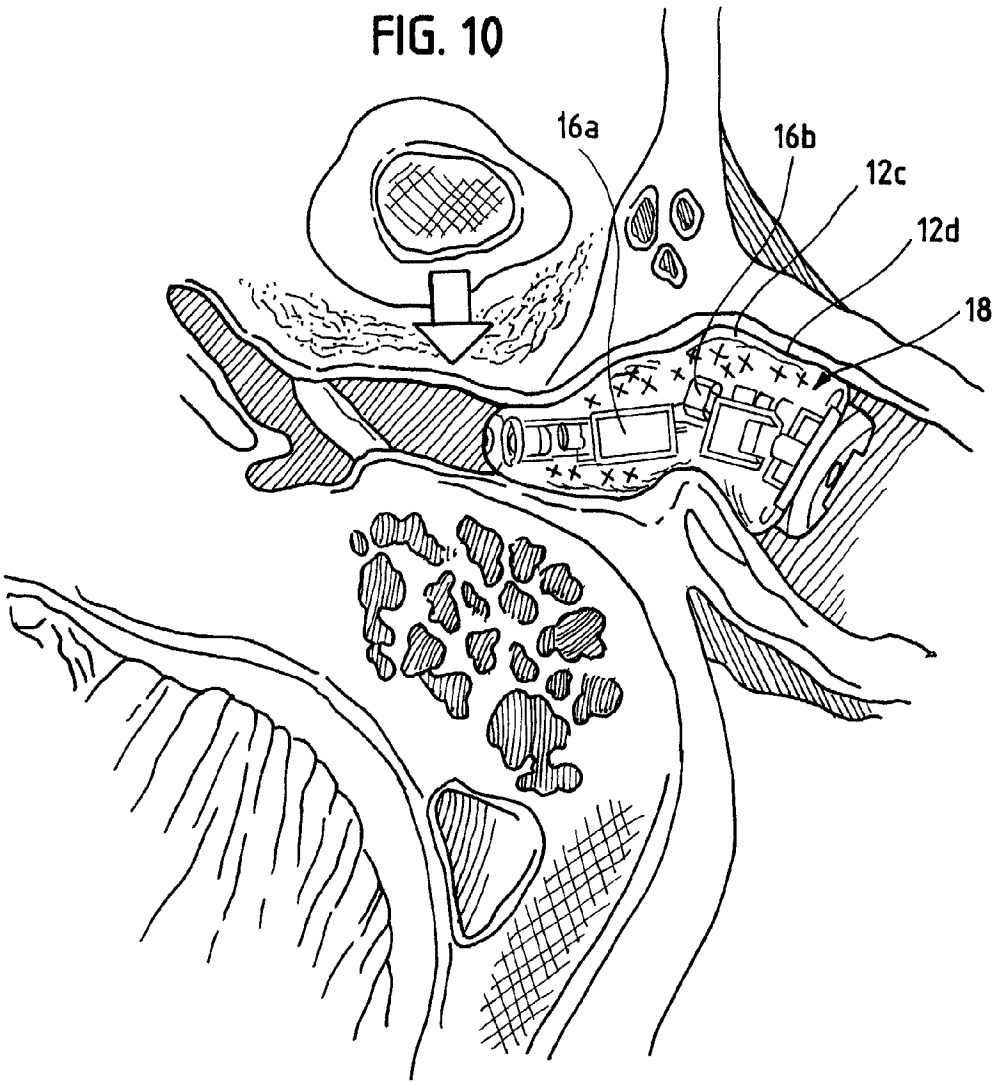
FIG. 10 is a side sectional view illustrating compression and distortion of the aid of FIG. 5A subsequent to insertion.

FIG. 10 illustrates aid 10 fully inserted into the canal. The skin 12 and matrix 18 are distorted by the shape of the canal due to a closed mandible M. As discussed above relative to FIG. 5B, the matrix 18 exerts a gentle expansive force which maintains the external periphery 12*d* of the skin 12 in contact along a substantial portion of the canal. The length of contact, or seal region, of the skin 12 with the canal will substantially exceed the contact area of a rigid shell aid with the canal. Hence, aid 10 can be expected to need smaller sealing forces, along the canal, due to the greater length along which the skin 12 seals against the canal.

Figure 11:
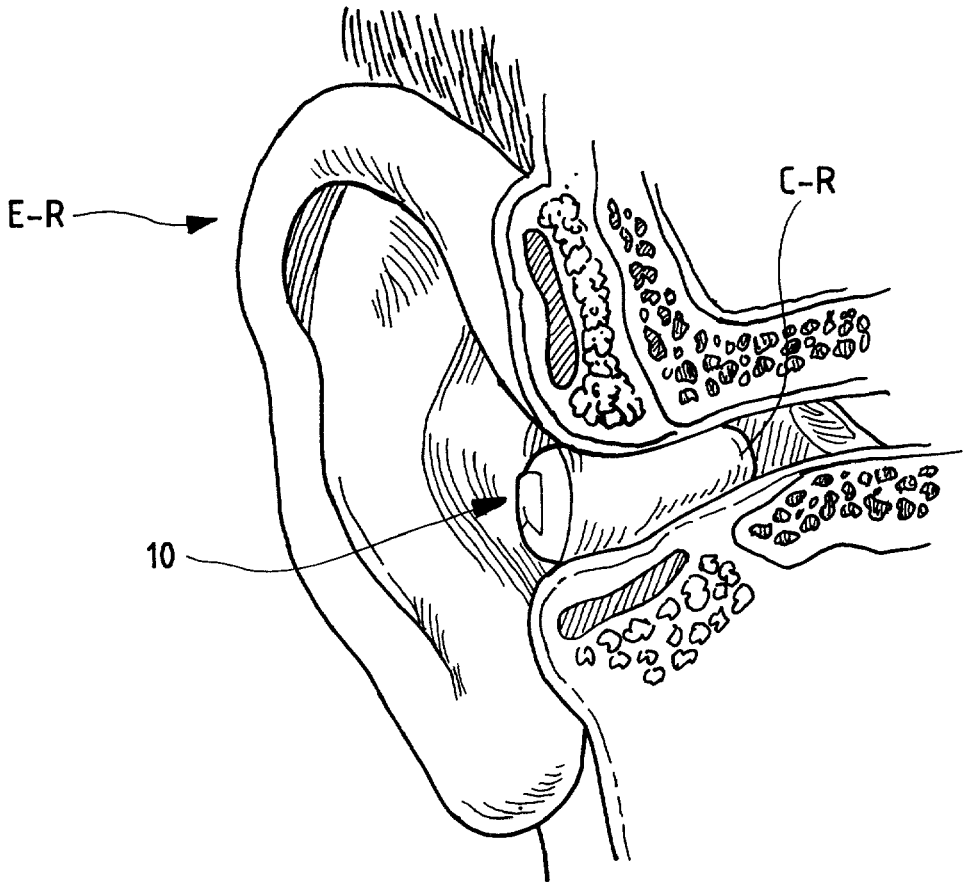
FIG. 11 is an anterior sectional view illustrating the aid of FIG. 5A after insertion.

FIG. 11 a front, anterior, view illustrates aid 10 inserted in the canal C-R from a plane perpendicular to the plane 3—3. The view of FIG. 11 does not reflect the two bends in the canal that the aid 10 must traverse during insertion and extraction. As a result, this view might suggest that relatively stiff, solid elastomeric structures could be successfully inserted into and retrieved from the canal. Such structures generate unacceptably high restoration forces when deformed as they may be deformable but they are not compressible.

Figure 12A:
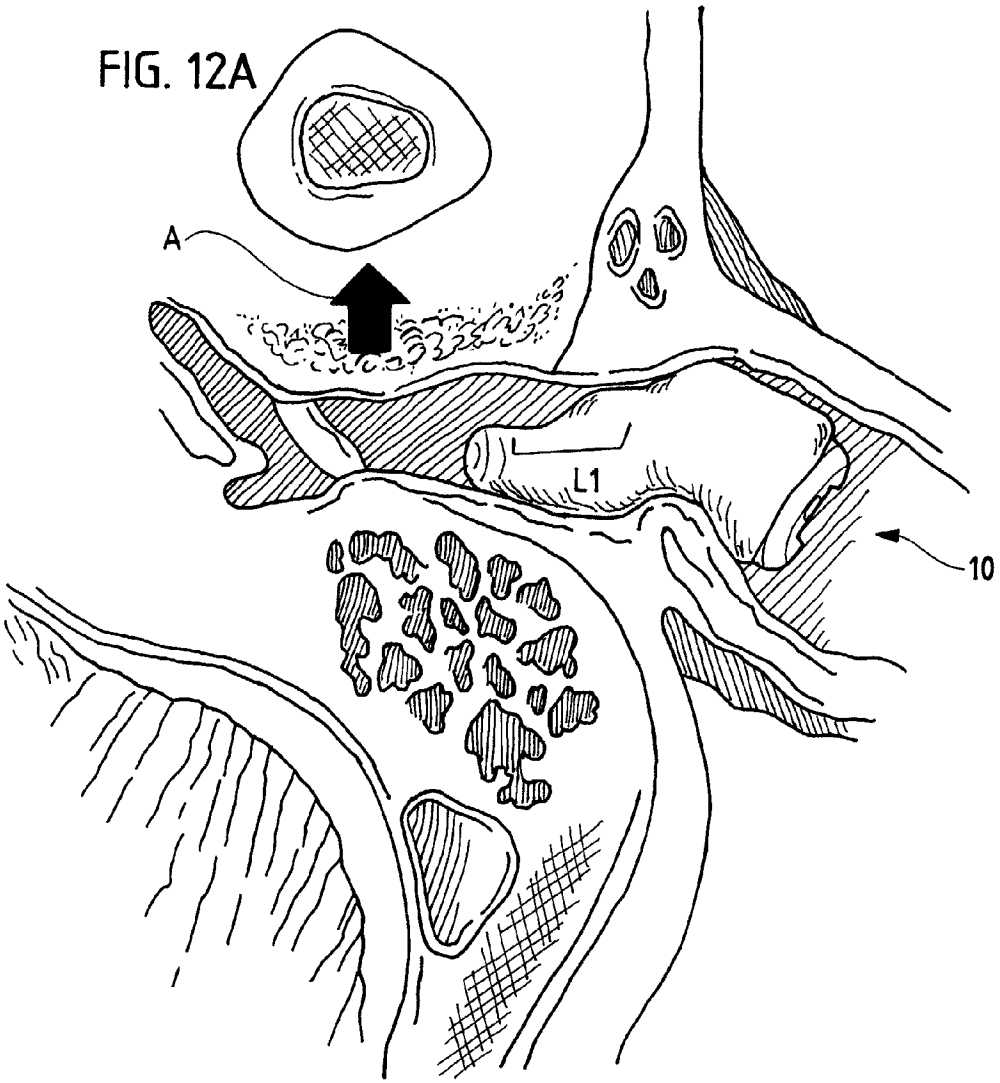
FIGS. 12A–12D taken together illustrate expansion and compression of the aid of FIG. 5A, after insertion into an ear canal and in response to mandibular movement.

FIGS. 12A,B, C and D illustrate a dynamic sequence starting from a mandible closed state, and going to a mandible open state. A momentary loss of seal in some regions along the length of the skin 12 and the canal, generally indicated at L1, see FIG. 12A, may be experienced. This condition, which will exist for a very short period of time, promotes ventilation and drying of the canal The aid 10 will reseal as discussed below.

Figure 12B:
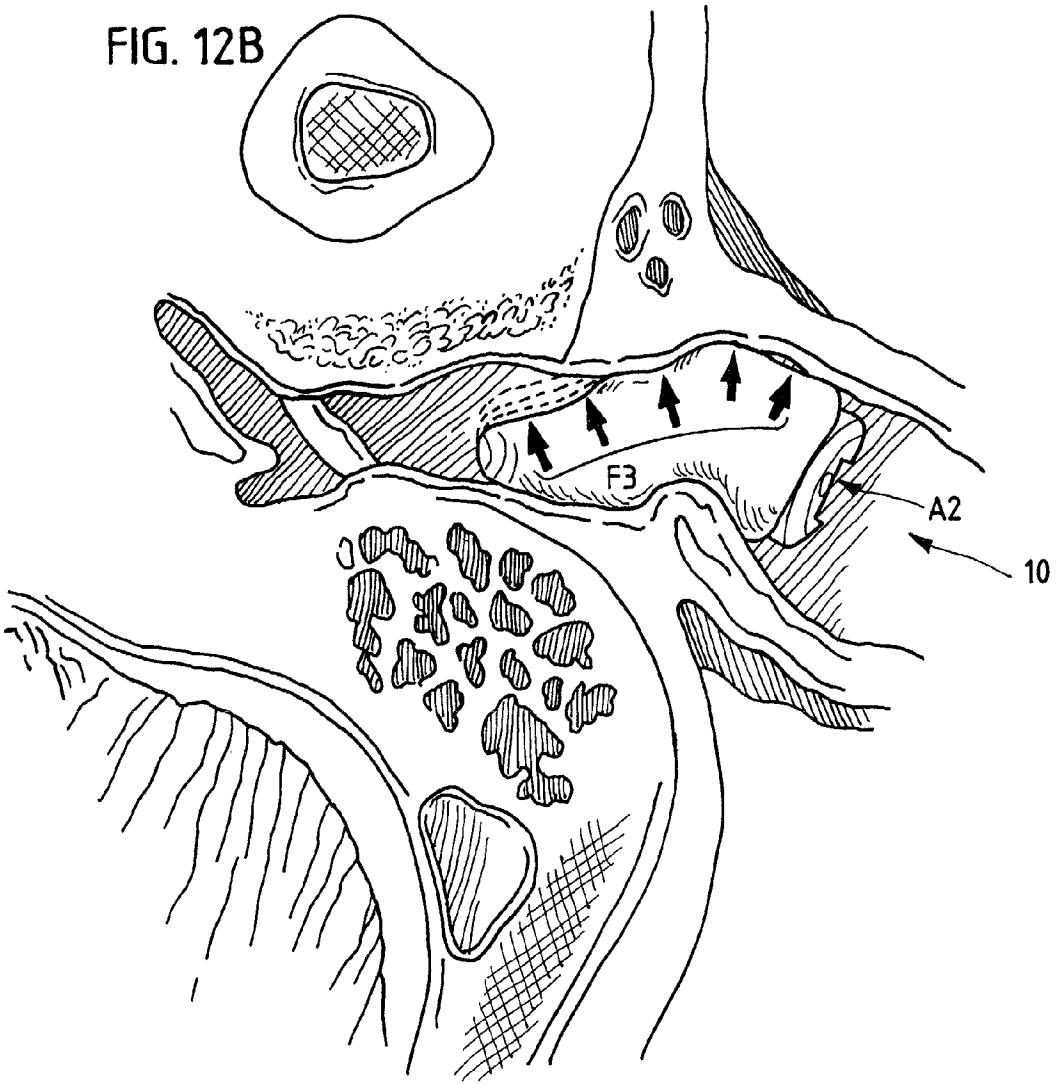

FIG. 12B illustrates the matrix 18 in the aid 10 exerting restorative forces F3 to expand the skin 12 to fill the enlarged portion of the canal in response to the mandible M moving to an open position due to talking or eating. The characteristics of the matrix 18 can be selected to optimize performance in resealing the canal and user comfort. For example, where the matrix 18 includes a foam, a slow recovery foam can be chosen. During the process of FIG. 12B, as the matrix 18 expands, it also expands the internal region 14. Ambient air A2 is drawn into the region 14 and into the matrix 18. As the sheath 12 expands, in response to inflowing air, it reseals against the canal.

Figure 12C:
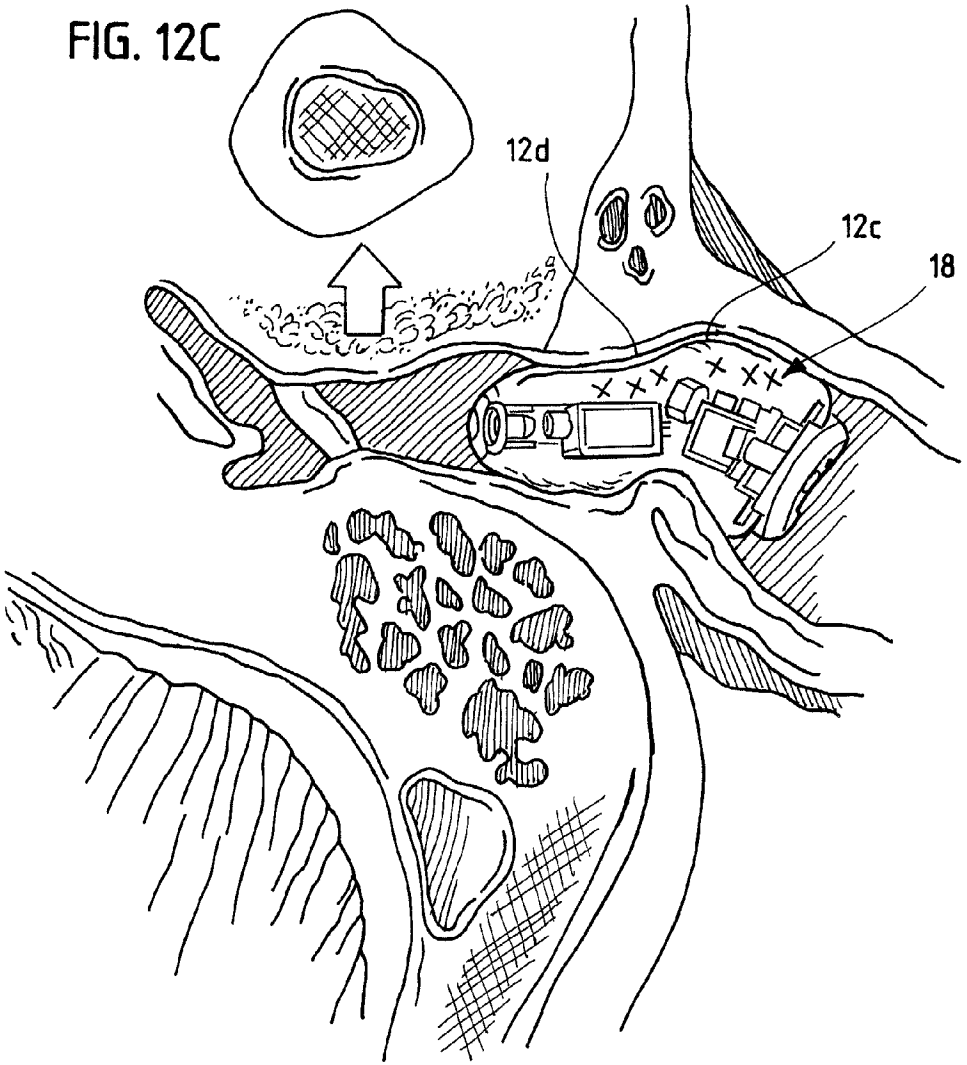

FIG. 12C illustrates aid 10, partly in section, with matrix 18 expanded to reseal the exterior periphery 12*c* along the ear canal. In this state, matrix 18 is less compressed.

Figure 12D:
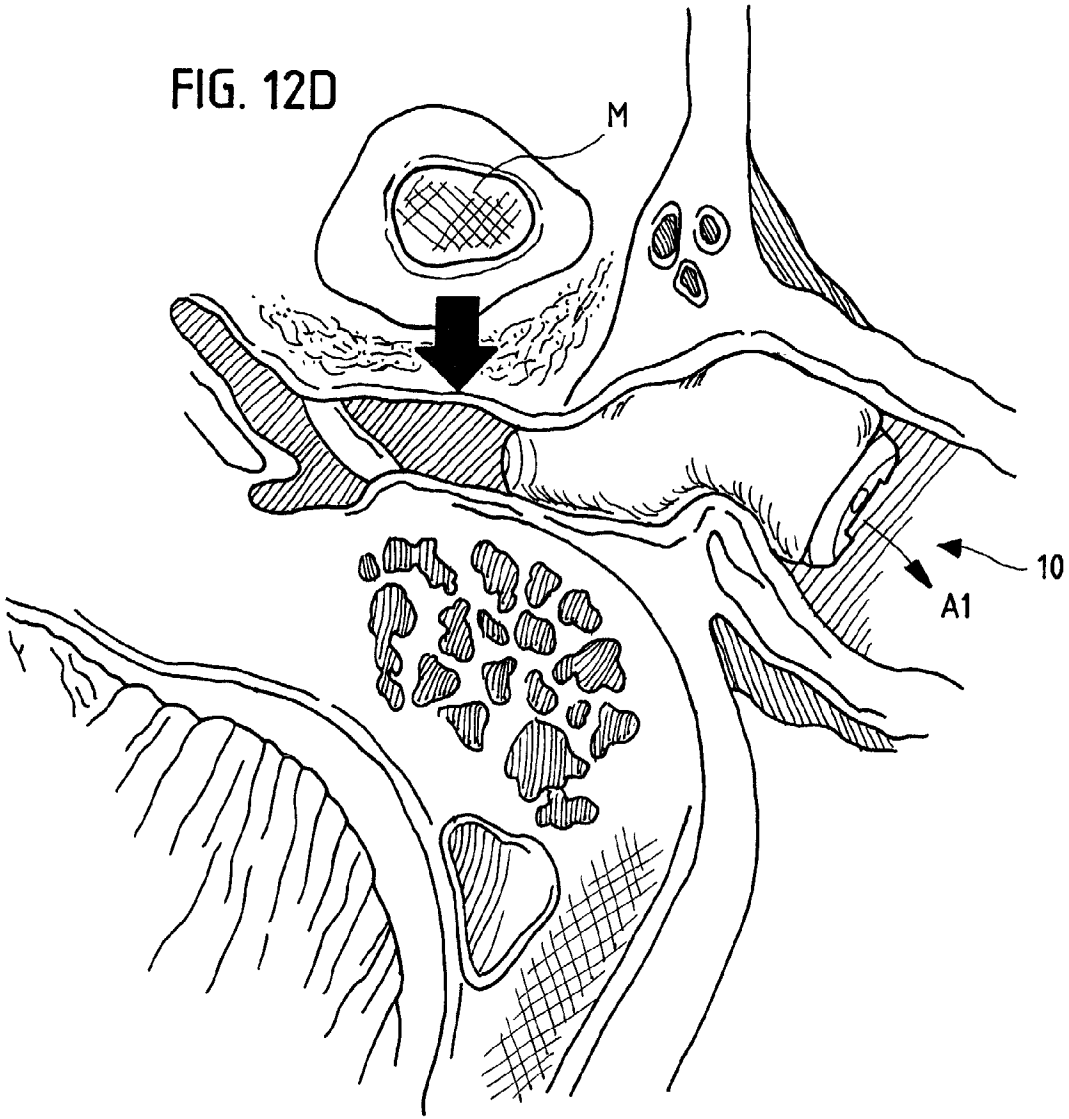

FIG. 12D illustrates the mandible M moving to a closed position. The aid 10 is now subjected to compression forces as the canal changes shape and exhibits a smaller cross section. In this circumstance, the matrix 18 is compressed and the volume of the region 14 decreases. However, pressure against the ear canal, from the matrix 18 does not substantially increase as air A1 in the skin 12 is expelled therefrom. When the mandible M again moves to an open state, the process repeats.

The compressible characteristics of the matrix 18 and the expulsion of air from skin 12 limit forces applied to the canal to those generated by the matrix 18. No forces are generated as would be exhibited by the deformation of a solid elastomeric body nor due to reduction in volume of trapped gases, as in a sealed bladder.

To manufacture a hearing aid in accordance with the present invention an ear impression is made of the ear canal of the ear of the expected user as is conventionally done when fitting hearing aids. Then, using known methods, a thin, rigid acrylic shell is formed. This shell has an exterior periphery substantially identical to the exterior periphery of the of the ear impression. Such steps are well known to those of skill in the art and need not be discussed further.

FIGS. 13A–13E illustrate steps preparatory to molding in accordance with the present invention starting from the availability of a rigid shell 50 based on the user's ear impression. The shell 50 has an inner ear end 50-1 with a receiver output port 50*a* and a vent port 50*b*.

Figure 13A:
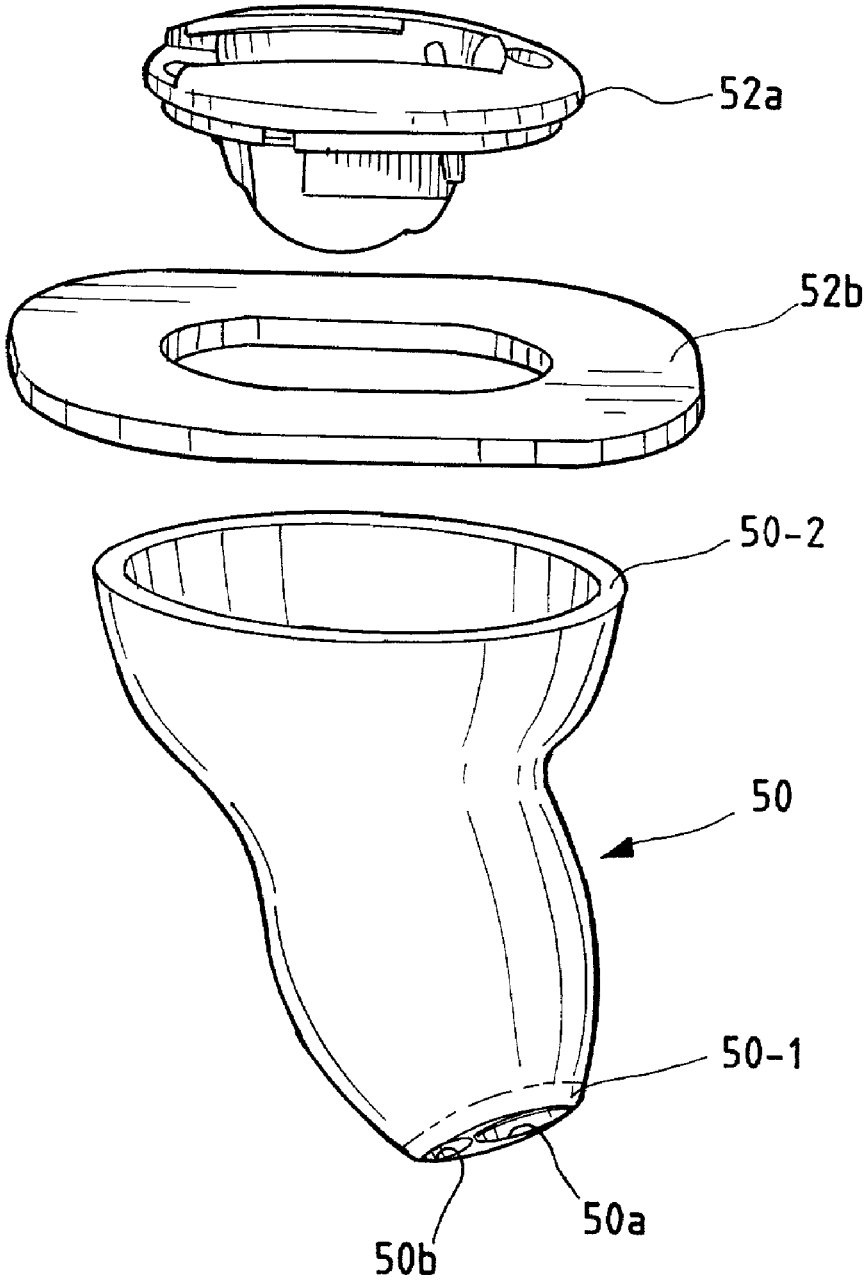
FIGS. 13A–13E taken together illustrate premolding steps of a method in accordance with the present invention.
Figure 13B:
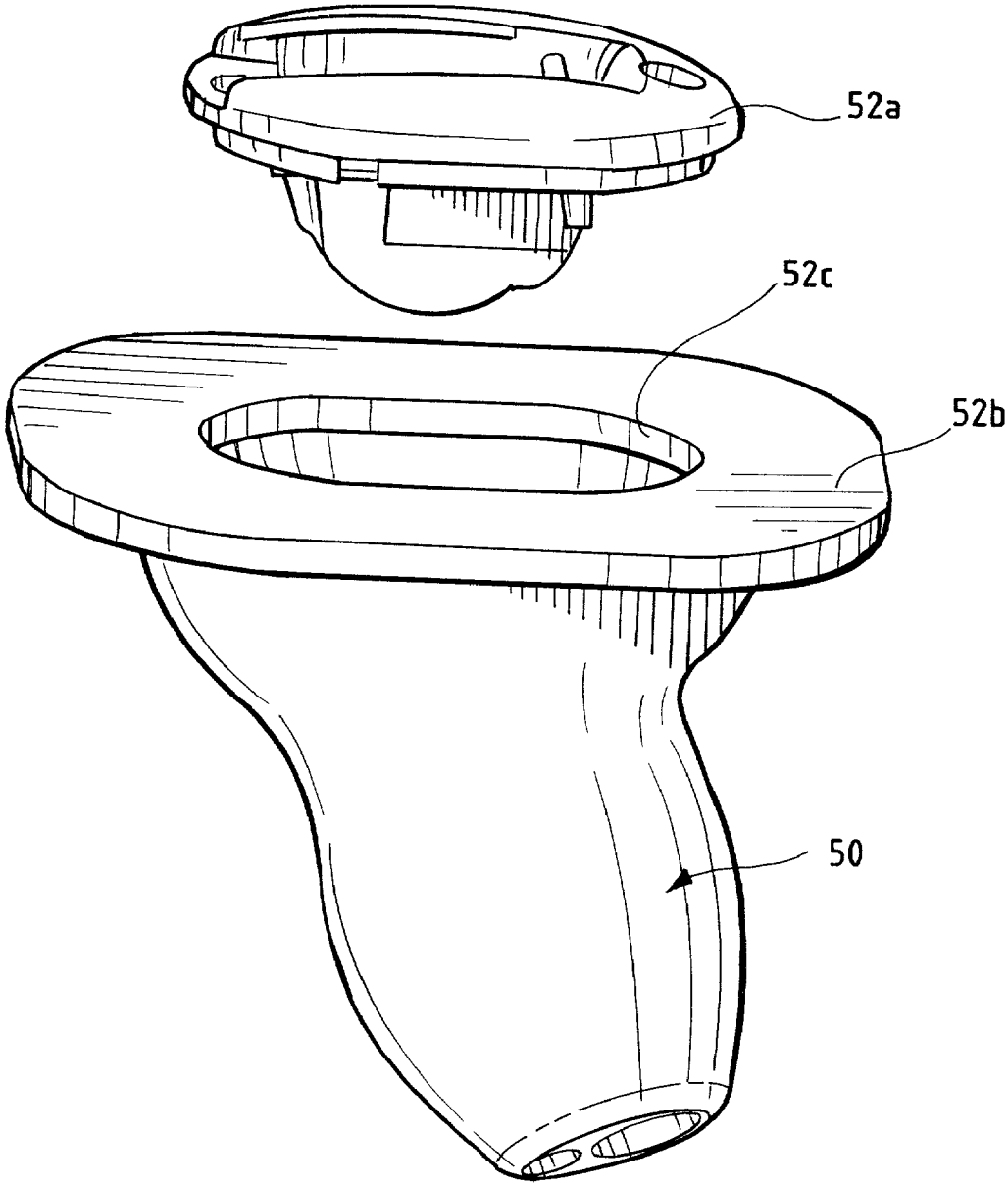
Figure 13C:
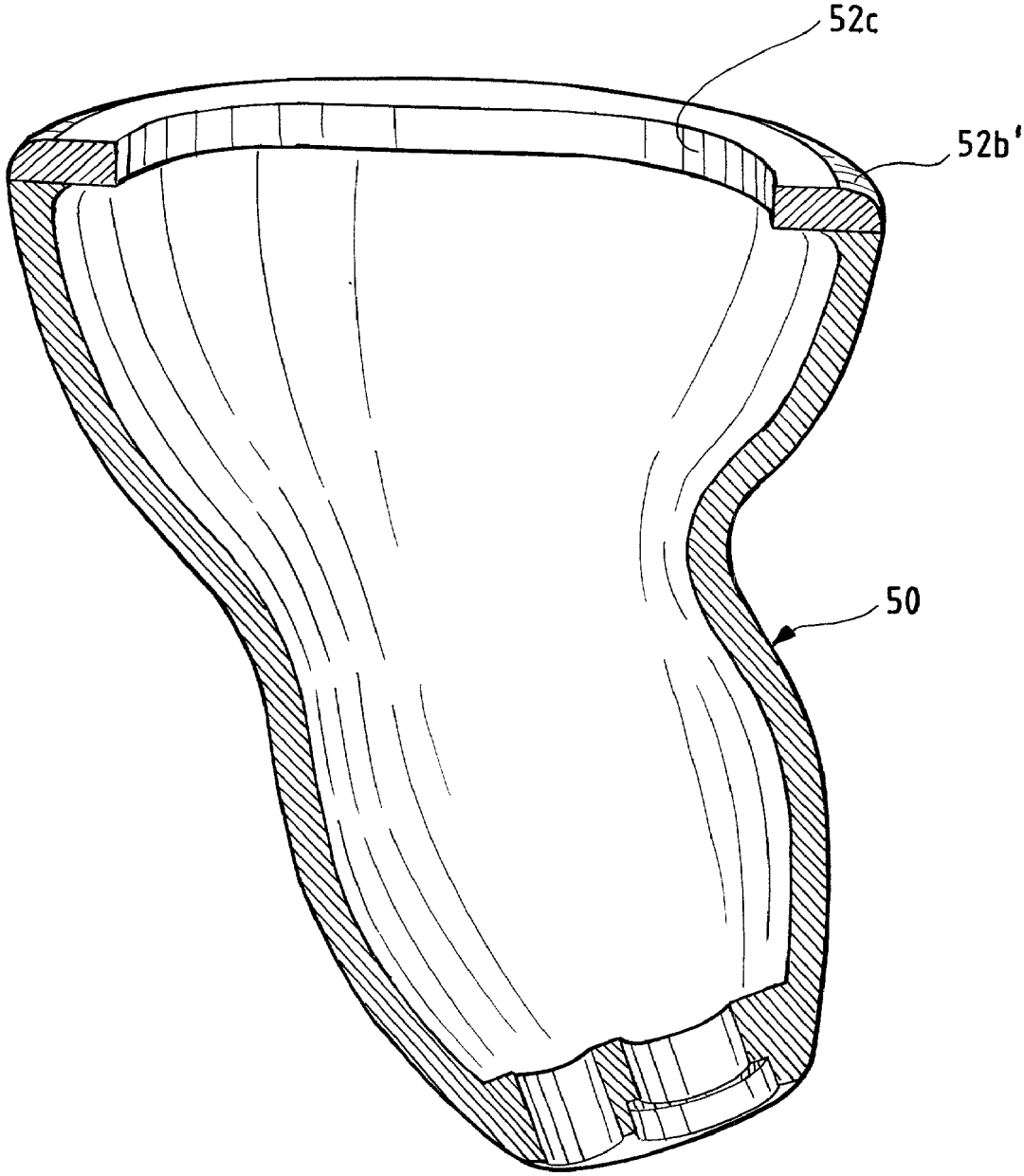

In the step of FIG. 13A a dummy electronic module 52*a* is inserted into one of several standard modular face plate blanks, such as blank 52*b* which has one of several standardized module receiving openings 52*c*. Faceplate blank 52*b* can then be optimally positioned on outer ear end 50-2 of the shell 50. It can then be attached thereto with adhesive and trimmed to become a master 52*b*' for a standardized opening 52*c* in the soft shell which can receive a selected modular faceplate assembly, see FIG. 13C.

Figure 13D:
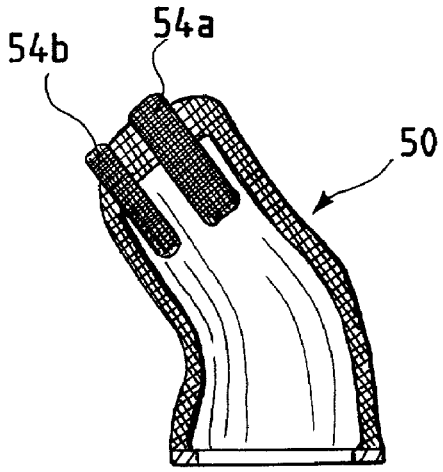
Figure 13E:
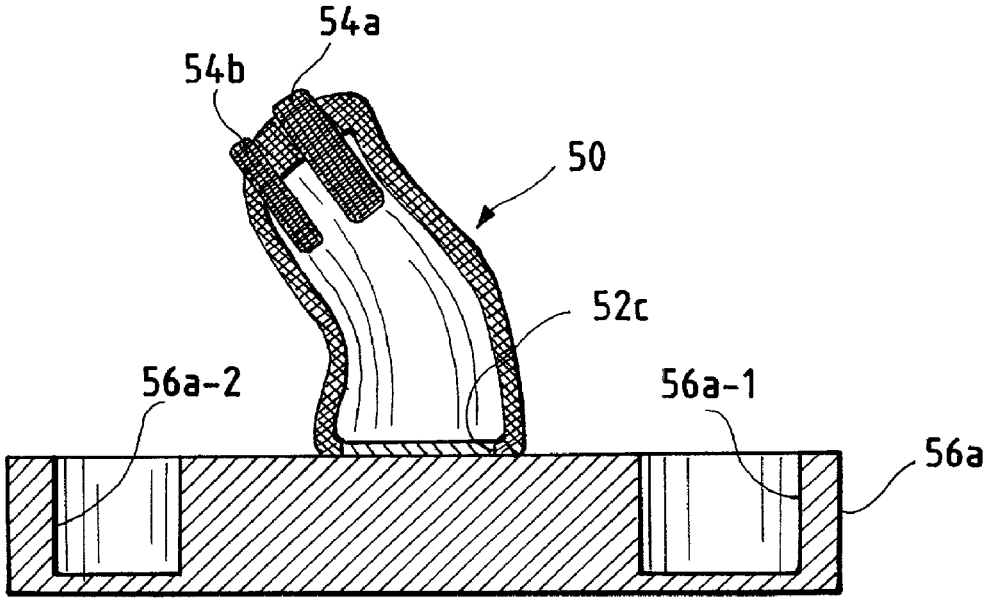

In FIG. 13D the receiver output port 50*a* and vent port 50*b* are closed with removable pins 54*a,b*. In FIG. 13E the shell 50 is removably attached to a keyed molding plate 56*a* using the opening 52*c*. The plate 56*a* is keyed for rotary alignment with openings 56*a*-l,-2. Using the opening 52*c* provides appropriate axial positioning as illustrated subsequently.

Figure 14A:
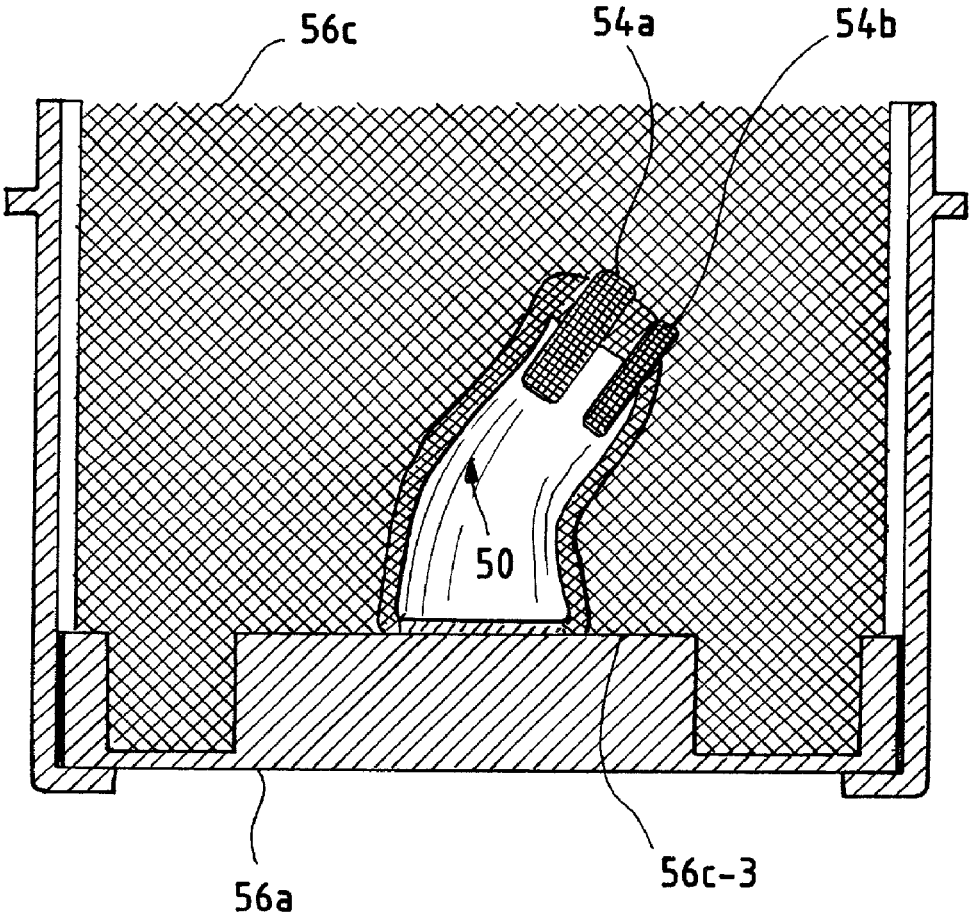
FIGS. 14A–14D taken together illustrate molding steps of a method in accordance with the present invention.

FIGS. 14A–14D illustrate molding steps in accordance with the present invention. In FIG. 14A plate 56*a* is illustrated in molding container 56*b*. The container 56*b* has been filled with a commercially available silicone molding material thus forming a cured female impression of the shell 50.

Figure 14B:
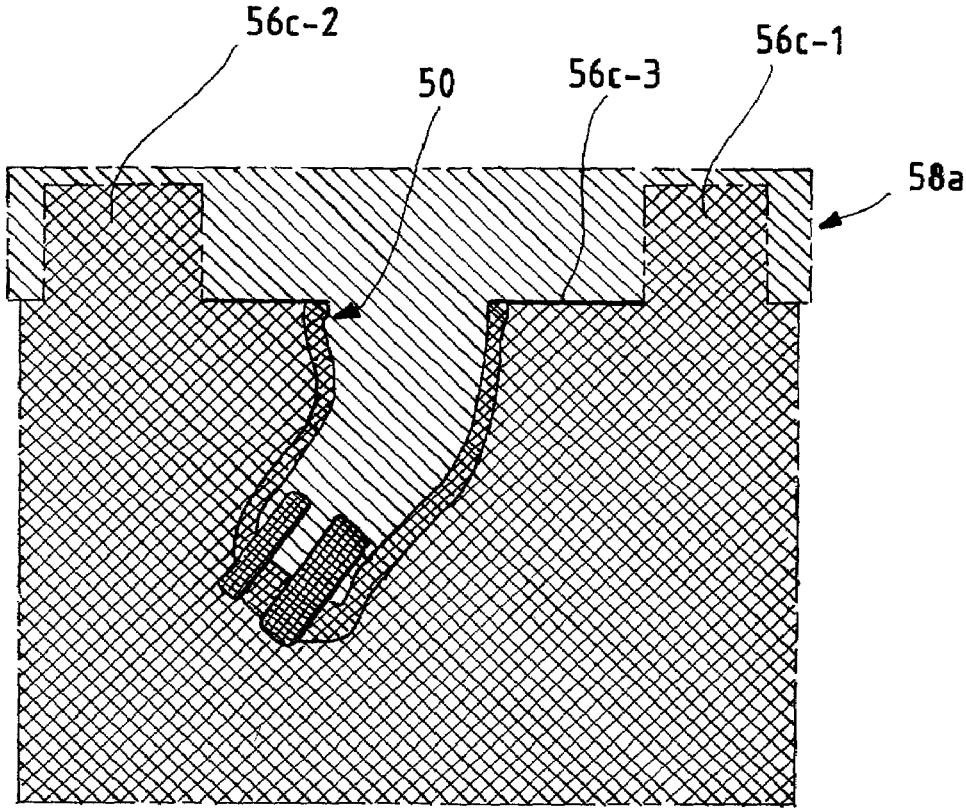

FIG. 14B illustrates the female mold 56*c* turned over, plate 56*a* has been removed. Silicon molding material has been poured into the shell 50 thereby forming a silicone male mold thereof. 58*a*. The mold 58*a* is rotatably keyed to the mold 56*c* by locating posts 56*c*-1,-2 formed in the female mold 56*c*. The mold 58*a* is axially keyed to the mold 56c by the surface 56*c*-3.

Figure 14C:
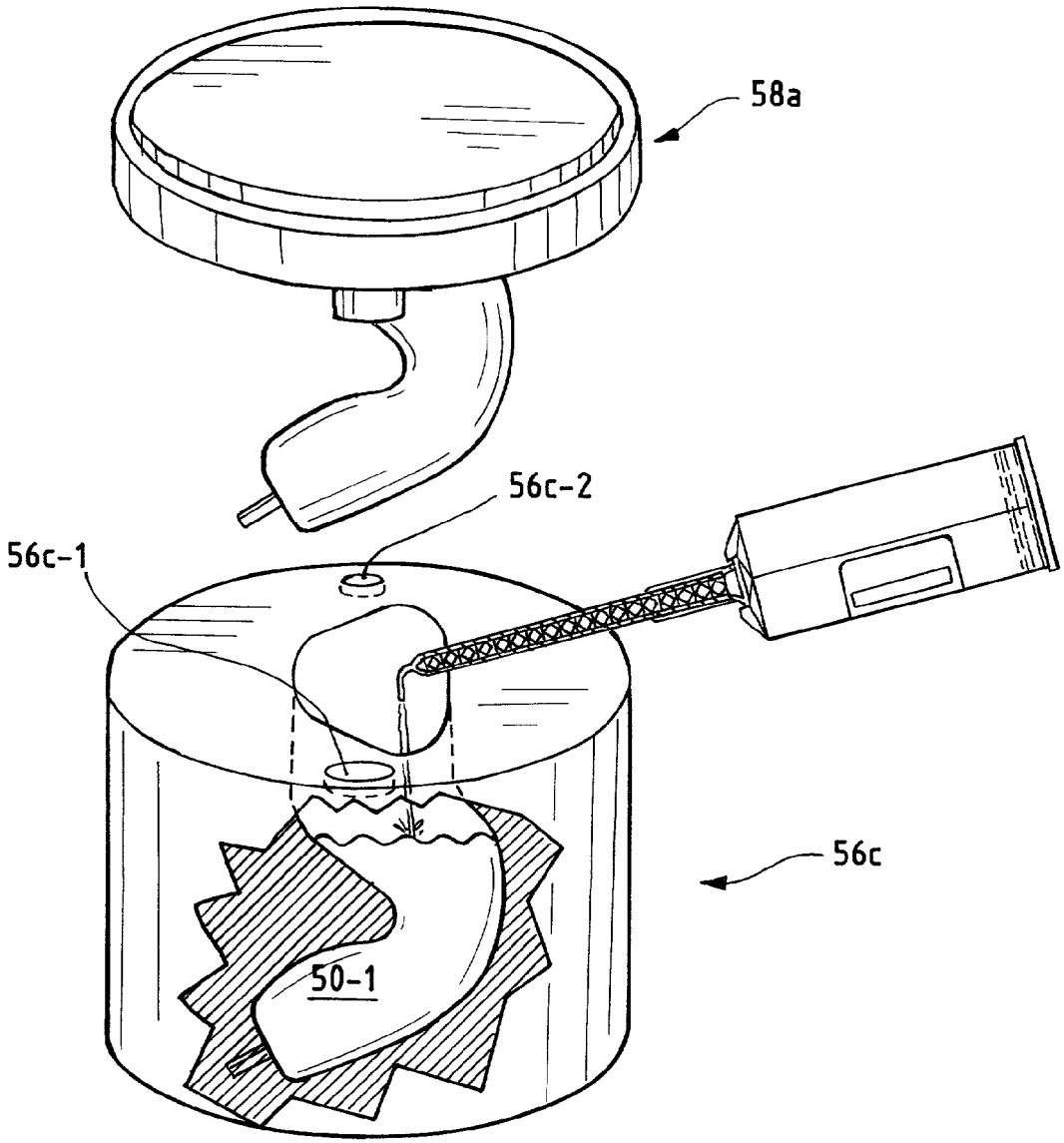

In FIG. 14C the rigid shell 50 has been removed from between the male and female molds, 58*a*, 56*c*. The space therebetween, in female mold 56*c*, can then be filled with a curable elastomer such as elastomer 50-1. The male mold 58*a* is reassembled with the female mold 56*c* forcing the excess elastomeric material 50-1 therefrom.

Figure 14D:
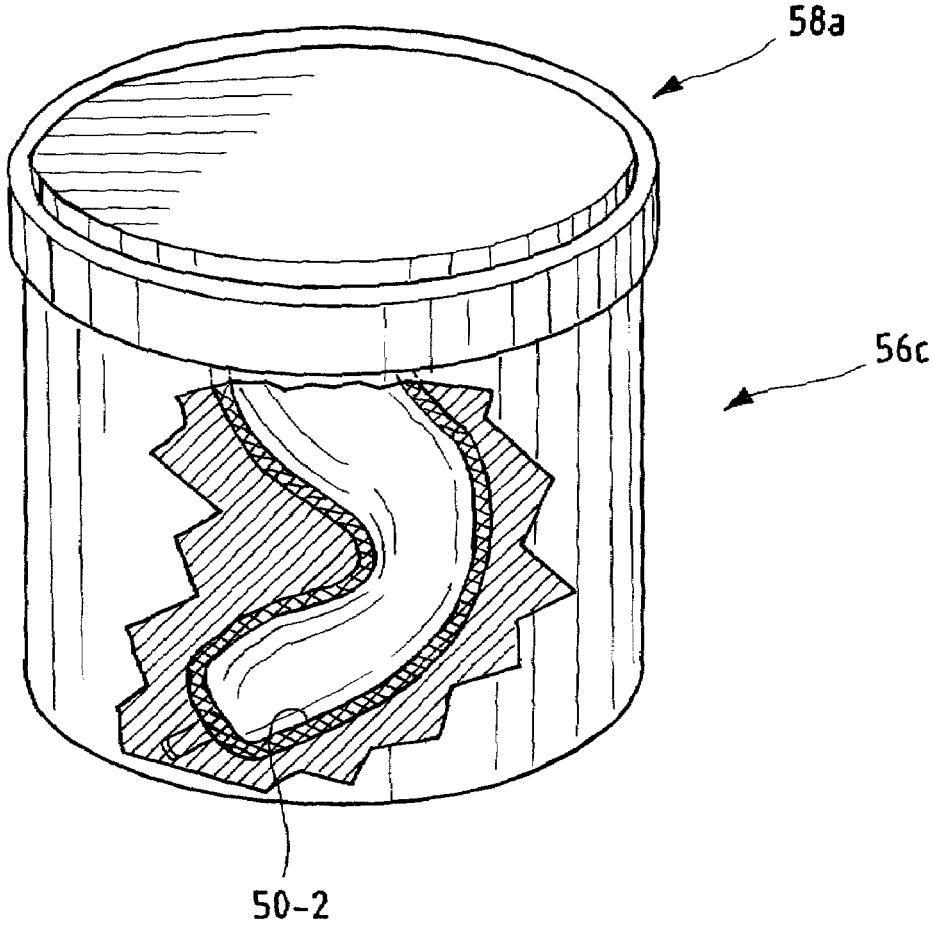

A deformable, elastomeric counterpart 50-2, see FIG. 14D, of the rigid shell 50 is then formed in the space between the molds 58*a*, 56*c*. The elastomeric counterpart 50-2 corresponds to skin 12 when cured. The skin or sheath 12 is then removed from between the molds 58*a*, 56*c*.

Once the skin 12 has been formed, an electro-mechanical core or module for insertion therein can be formed. The receiver 16*a*, processing circuits 16*b*, microphone 16*d* and related components and wiring along with matrix 18 can be inserted into soft shell 12.

Figure 15A:
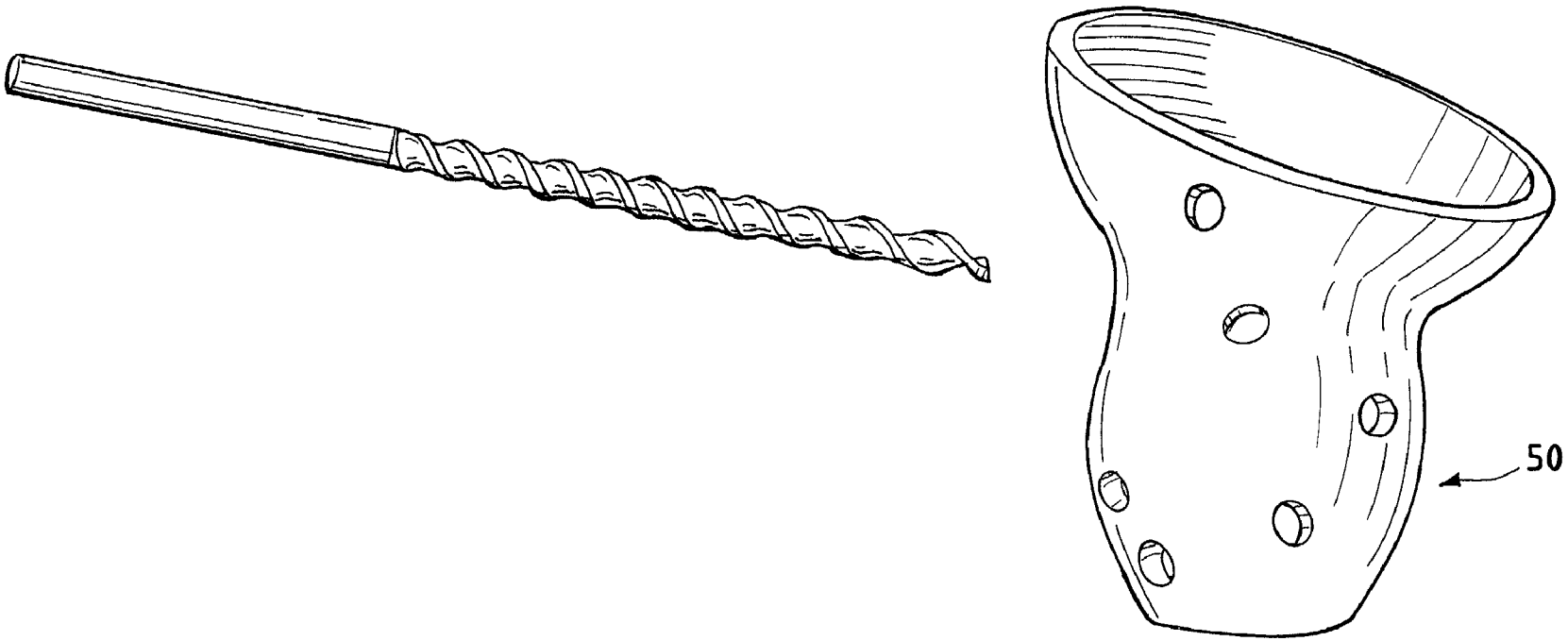
FIGS. 15A–15E illustrate various assembly steps of a method in accordance with the present invention.
Figure 15B:
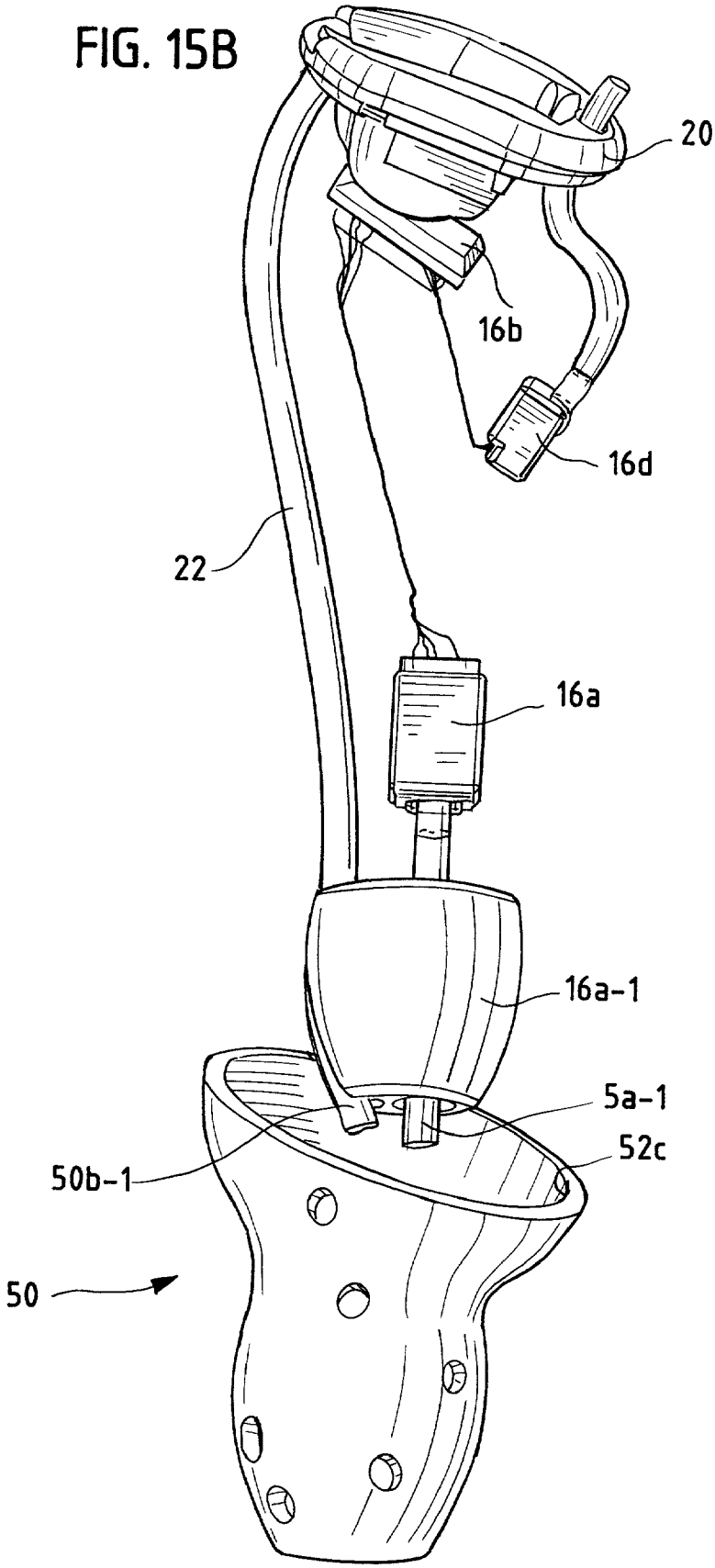

Preferably the core and matrix 18 will be formed to a shape compatible with the interior region of the soft shell 12. As illustrated in FIG. 15A the rigid shell 50 is preferably first perforated, for example by drilling various holes therein. Then, as illustrated in FIG. 15B a pre-formed faceplate 20 with an alignment surface which matches opening 52*c*, see FIG. 13D, is inserted into shell 50. The receiver 16*a*, processing circuitry 16*b*, and microphone 16*d* are all interconnected by a connection system of a type disclosed in pending U.S. patent application, Ser. No. 09/888,898 filed Jun. 25, 2001 assigned to the assignee hereof, entitled "Hearing Aid Connection System" and incorporated herein by reference.

Prior to insertion, the receiver 16*a* can be enclosed in compressible matrix 16*a*-1 which could for example be implemented as a pre-molded open cell foam. Other foam fillers can be inserted so as to be adjacent to processing circuits 16*b* and microphone 16*d*.

Figure 15D:
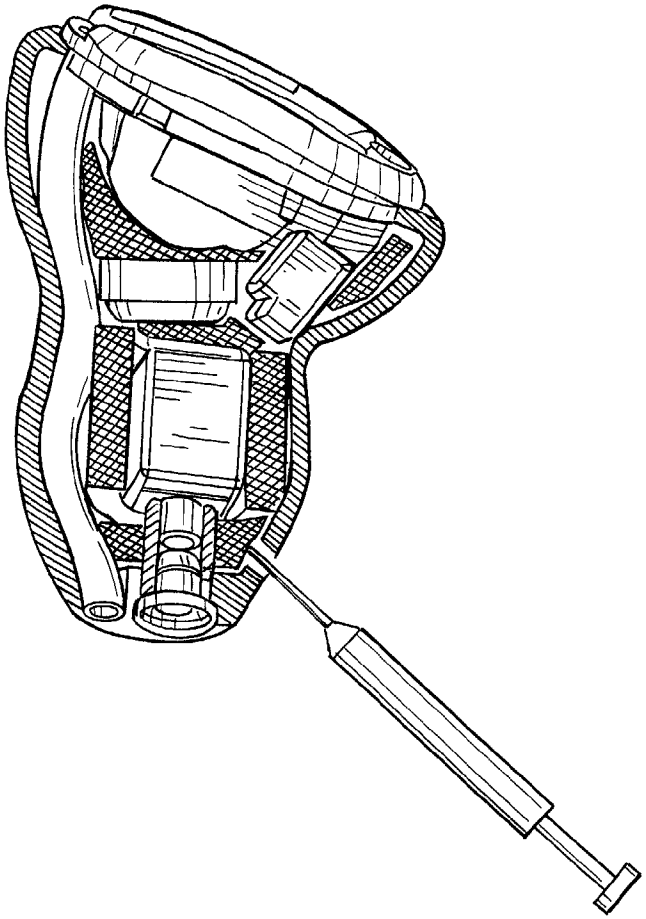
Figure 15C:
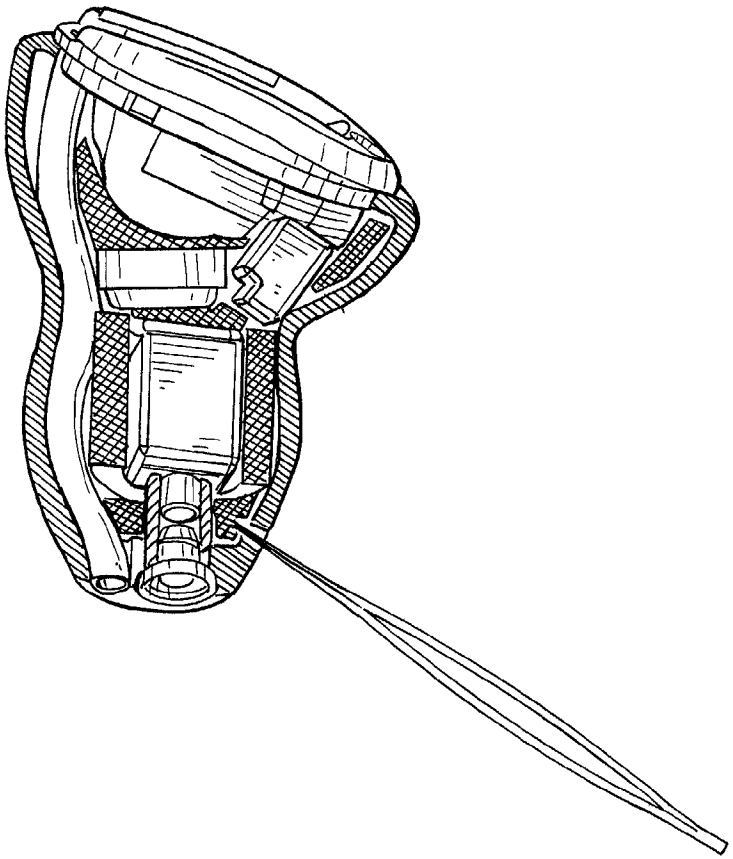

As illustrated in FIG. 15C, additional foam pieces can be inserted into the shell 50 through holes therein to fill some of the remaining spaces inside of shell 50. Then, as illustrated in FIG. 15D, additional elastomeric material can be injected, via holes in shell 50 which when cured will connect the various pieces of foam to form a unitary electro-mechanical core or modular structure 10-1, see FIG. 15E, at least partly enclosed by the foam.

Figure 15E:
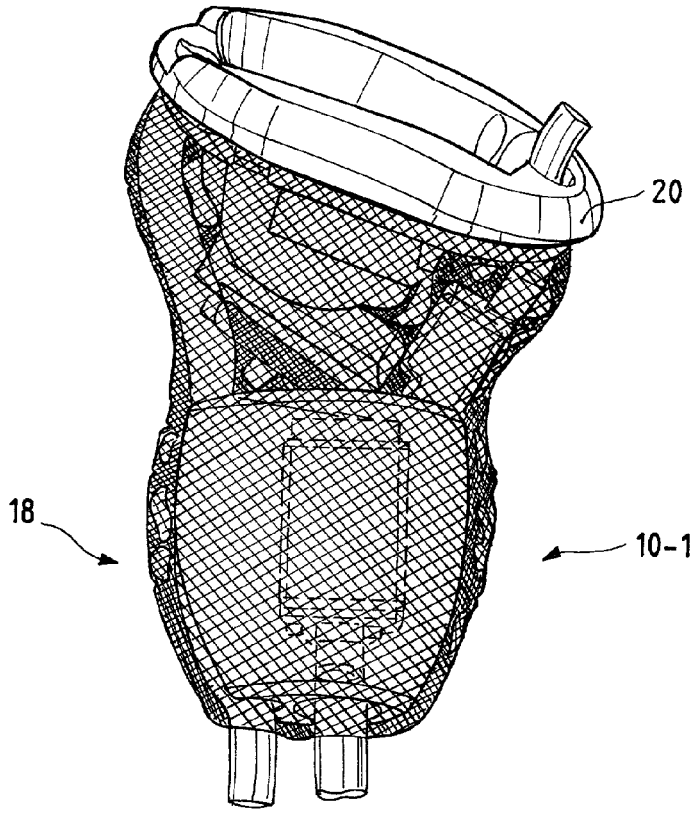
Figure 15E:
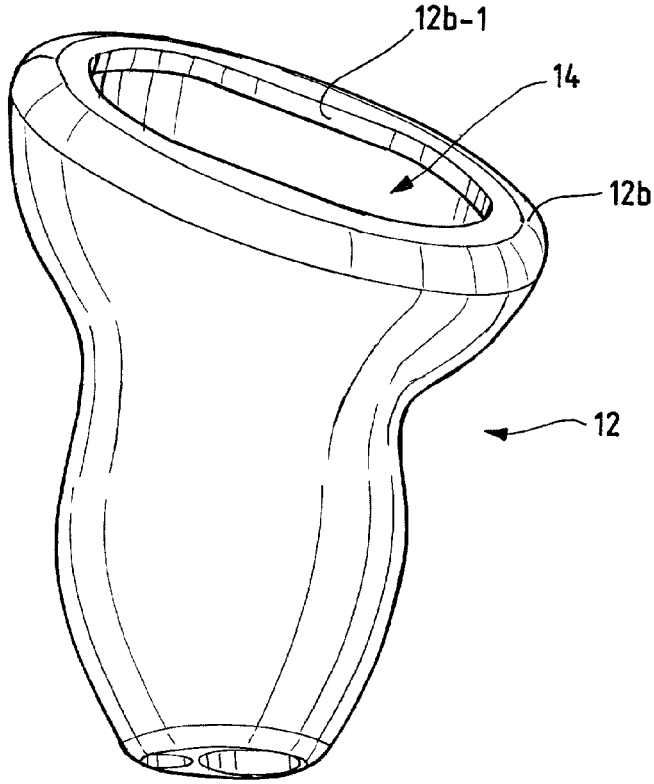

The modular structure 10-1 can then be extracted from the shell 50 by breaking same apart. As illustrated in FIG. 15E the module 10-1 can then be inserted into the skin 12. Alignment is achieved in that the opening 12*b*-1 at the outer ear end 12*b* has a selected shape and orientation corresponding to the form factor of opening 52*c*, see FIG. 13C, which orients the faceplate 20 and the remainder of module 10-1.

The faceplate 20 of the module 10-1 can be glued, welded to or clamped to the outer ear end 12*b* of the skin 12. Adhesive such as rubberized cyanoacrylate can be used, alone or in combination with silicone RTV-type adhesive. It will be understood that the specific way in which the faceplate 20 is bonded to the skin 12 is not a limitation of the present invention.

It will also be understood that the way the foam is configured about the receiver 16*a*, processing circuitry 16*b*, or microphone 16*d* can be varied without departing from the spirit and scope of the present invention. For example, those circuits could be inserted into shell 50 and a foaming elastomer injected thereinto and cured. This will produce an integrally formed module, similar to module 10-1, but not formed of discrete foam pieces. Other variations are possible without departing from the spirit and scope of the present invention. As discussed above, the application of a deforming force to the skin 12 will compress the matrix 14 expelling air from the skin 12 permitting the skin 12 and the matrix 14 to collapse and not apply increased forces to the adjacent part of the user's ear canal.

Figure 16:
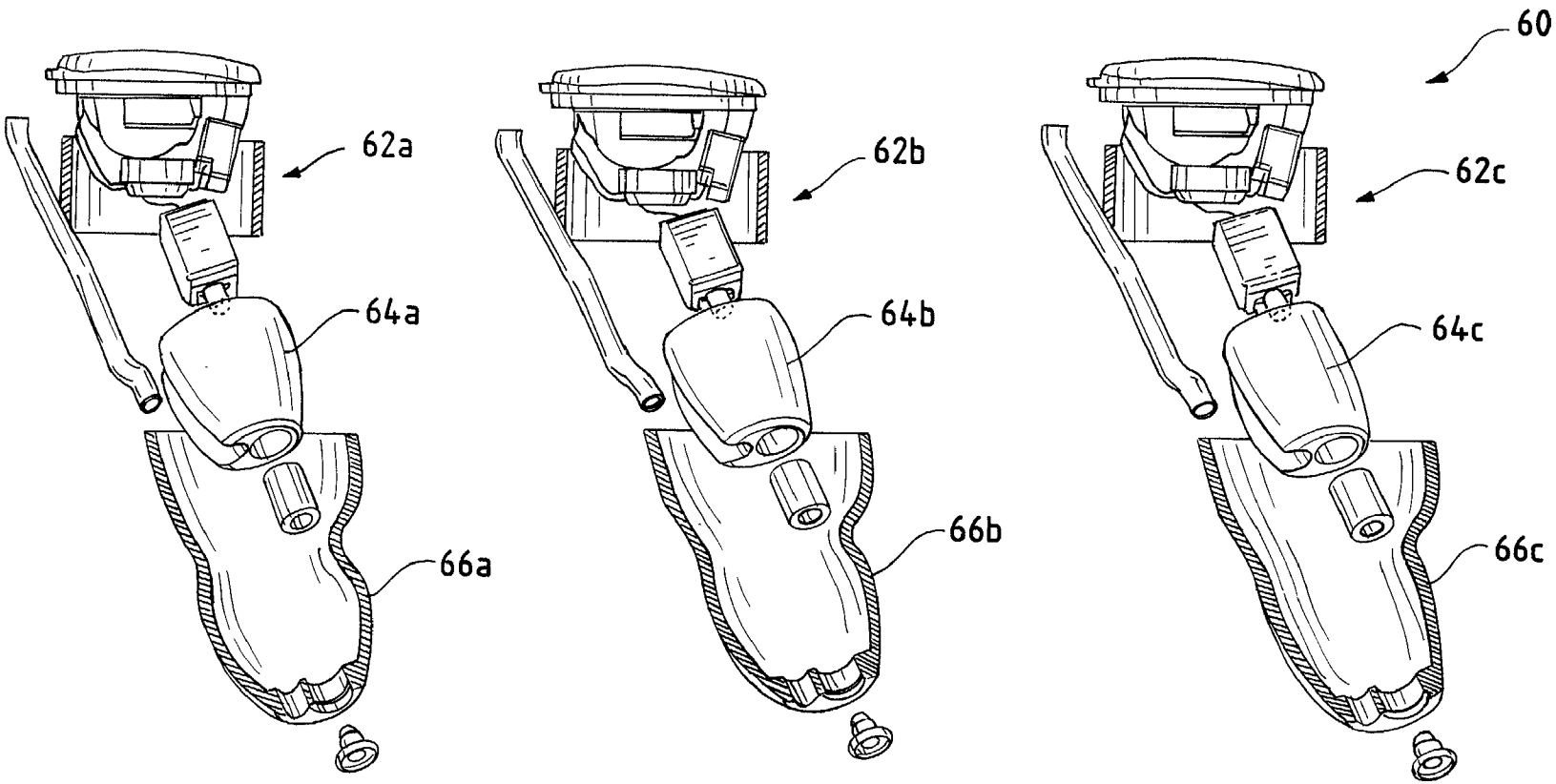
FIG. 16 illustrates aspects of a system of off-the-shelf, stock, modular hearing aids in accordance with the present invention.

FIG. 16 illustrates elements of an off-the-shelf, stock, modular hearing aid system 60. With a limited number of components, system 60 can be expected to produce compressible hearing aids to meet the needs of numerous members of the public without a need to create a customized aid.

The system 60 includes a plurality of faceplates with attached microphones, vent tubes, electronic systems and receivers such as 62*a,b,c*. The elements 62*a,b,c* can be mechanically identical with different electronic processing characteristics achieved by programming the signal processing circuitry. Alternately, the signal processing circuitry can be physically as well as electrically different.

So long as the faceplates each exhibit a common form factor, the elements 62*a,b,c* can be combined with pre-molded foam support elements 64*a,b,c* of different sizes and then inserted into deformable elastomeric skins, of different sizes, 66*a,b,c*. Then respective faceplate of the selected element 62*i* can be bonded to the respective skin 66*i* to form a complete hearing aid.

The respective aid can be programmed to set the processing characteristics in accordance with the user's needs. However, no physical construction or modification will be necessary to create a hearing aid to fulfill the physical and audio needs of most users.

While three exemplary sets of modular elements have been illustrated in FIG. 16 it will be understood that systems having additional modular elements come within the spirit and scope of the present invention.

Figure 17A:
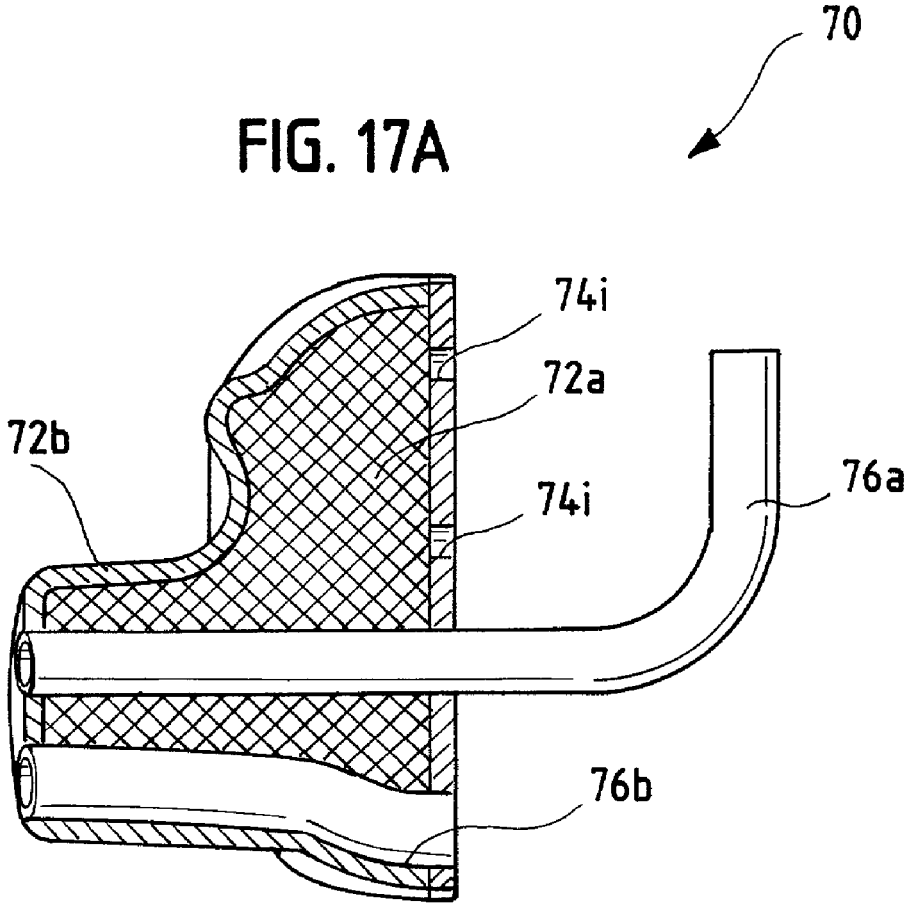
FIGS. 17A and 17B illustrate behind-the-ear hearing aid earpieces in accordance with the present invention.

FIGS. 17A,B illustrate earpieces for behind-the-ear hearing aid in accordance with the present invention. An earpiece 70, FIG. 17A, has a compressible matrix body 72*a* which is covered by a thin elastomeric skin or coating 72*b* of the type discussed above. The skin 72*b* exhibits at least one outflow port, such as port 74*i* which permits an outflow of air from matrix 72*a* as it is being compressed when inserted into the user's ear.

A tube 76*a* is provided and extends through the matrix 72*a* for coupling audio signals from the electronic package, located outside of the user's ear, to the ear canal. To increase user comfort, a vent 76*b* is provided.

Figure 17B:
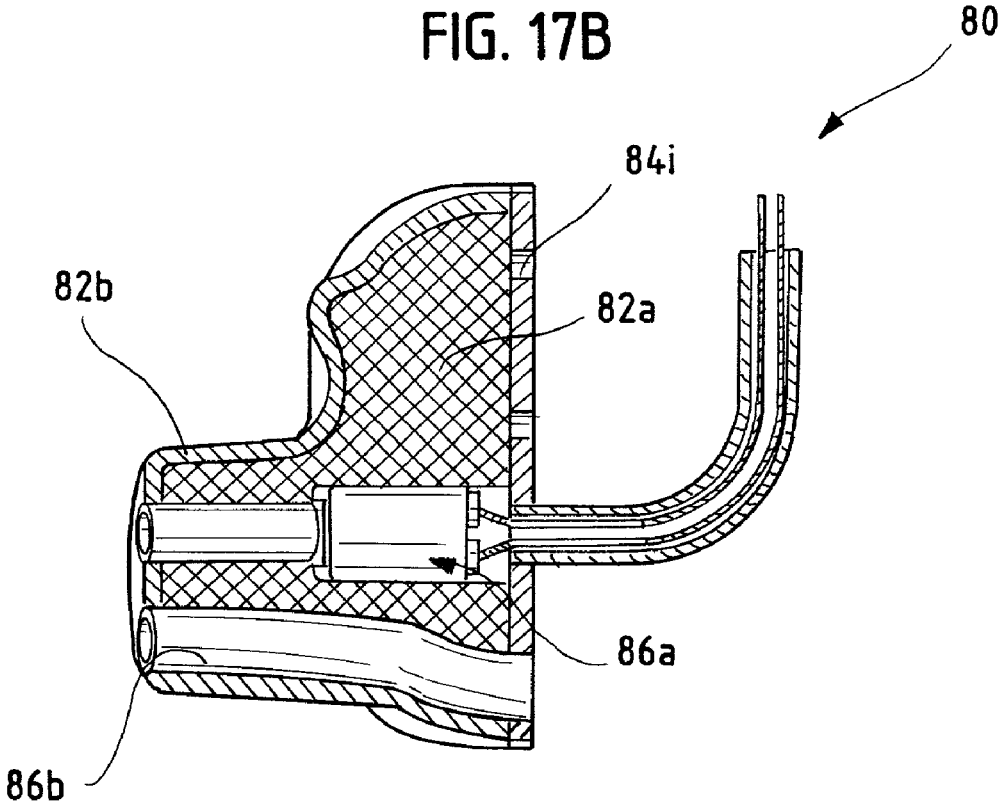

FIG. 17B illustrates a behind-the-ear earpiece 80 which incorporates a receiver 86*a* for converting electrical signals from the external ear circuitry to audio for injection into the user's ear canal. It will be understood that the earpiece 80 collapses on insertion into the ear canal as does the earpiece 70. Air forced from the matrix 82*a* is expelled via ports 84*i*.

Figure 18A:
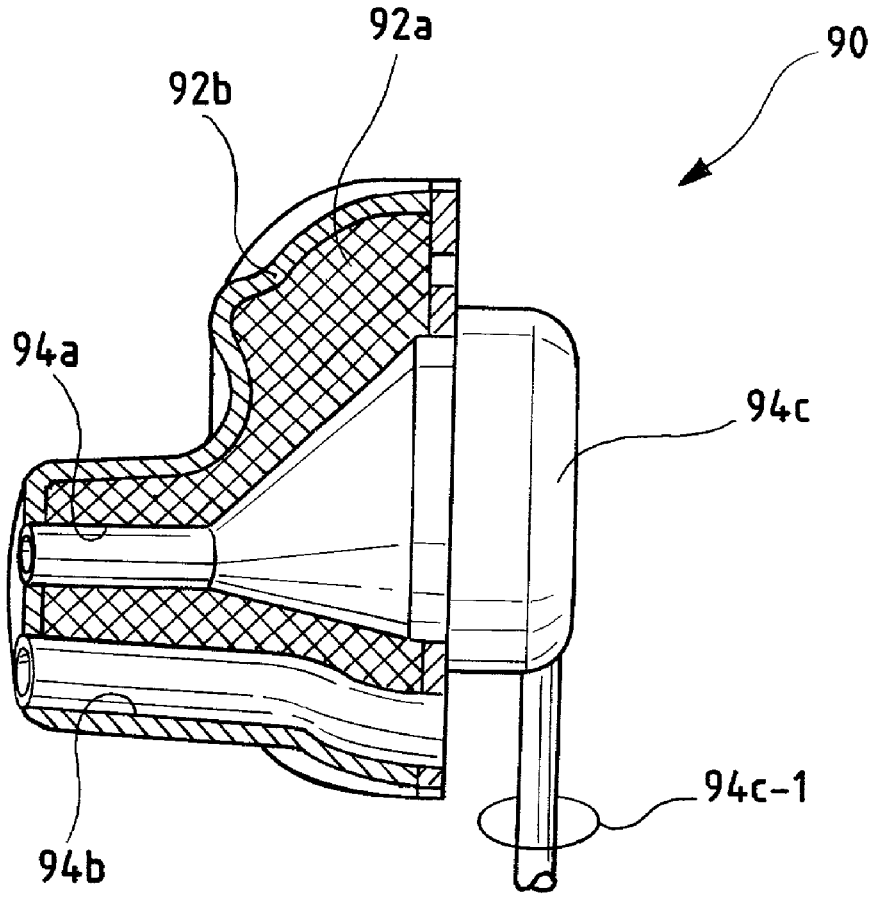
FIGS. 18A, 18B illustrate other earpieces in accordance with the present invention.

FIGS. 18A,B illustrate non-hearing aid communication devices in accordance with the present invention. These devices are usable with other types of electronic products such as wired or wireless telephones, RF communications equipment, portable CD players and the like.

FIG. 18A illustrates a snap-on device 90 which includes a compressible matrix 92*a* which is coated with an elastomer or enclosed in an elastomeric sheath 92*b*. Outflow ports 92*c* in the sheath 92*b* provide egress regions for air being forced from matrix 92*a* in response to being inserted into the user's ear canal.

An audio path 94*a* extends through body 92*a* into the ear canal end of the earpiece. The outer ear end of the body 92*b* can slidably engage, for example by a snap fit, a small speaker 94*c*. Alternate forms of attachment could also be used. The speaker 94*c* can in turn be coupled via to cable 94*c*-1 to a remote source of electrical signals. The body 92*a* can be removed from the speaker 94*c* and replaced as convenient. The unit 90 exhibits the same compressibility as discussed above and can be expected to fit comfortably in the user's ear canal.

Figure 18B:
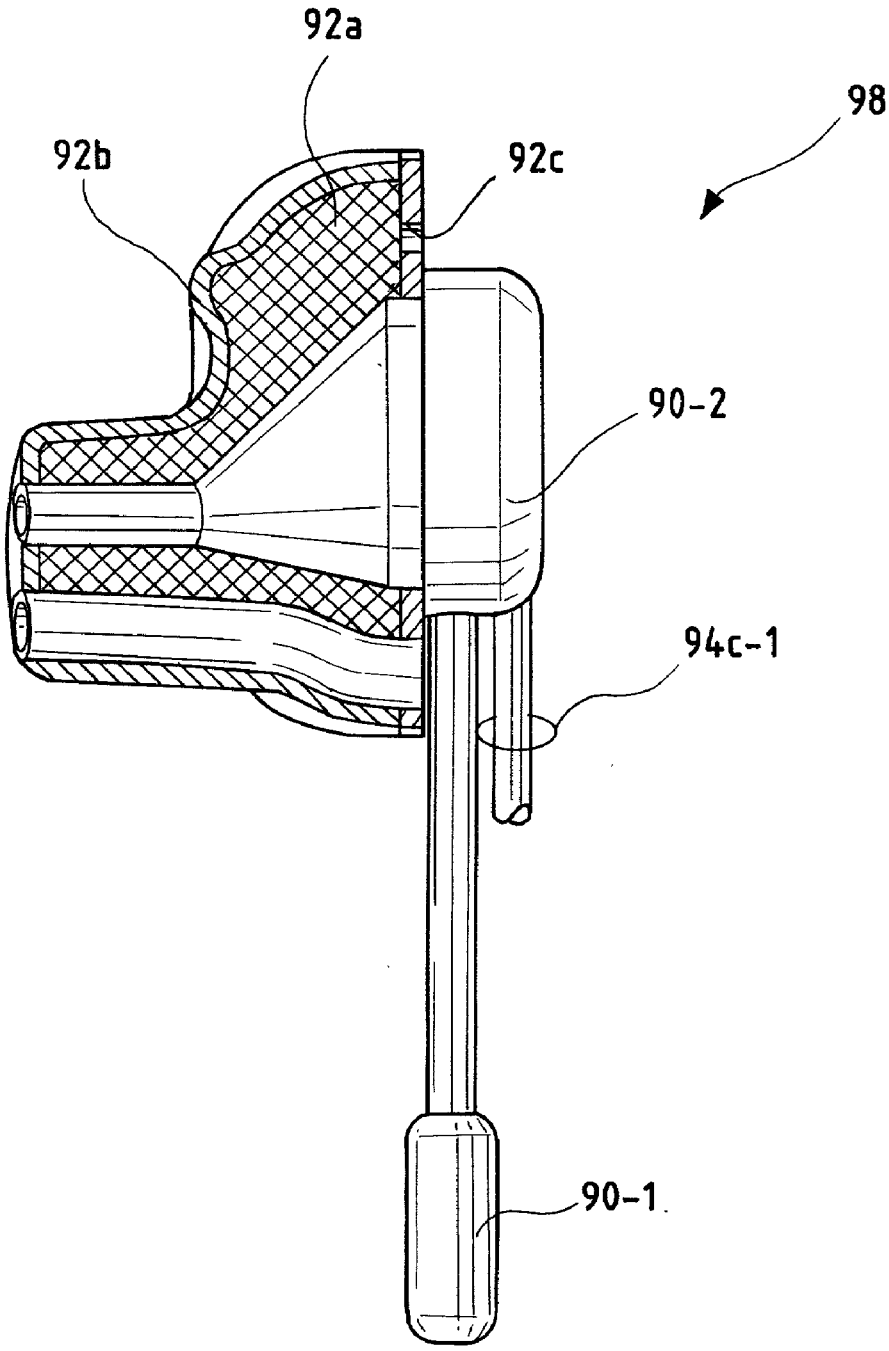

FIG. 18B illustrates a version 98 of the device 90 with a microphone 90-1 carried by the speaker 90-2. The body 92*a* slidably engages the speaker 90-2 with an interference fit and can readily be replaced.

Figure 19:
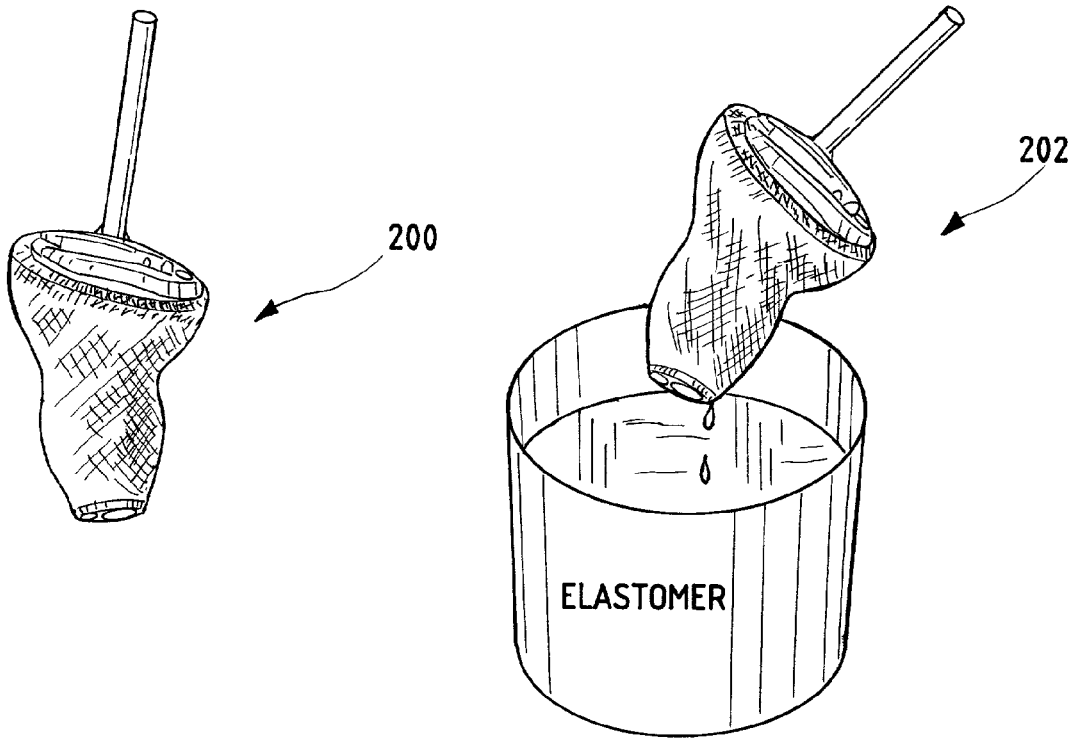
FIG. 19 illustrates steps of an alternate method in accordance with the present invention.

FIG. 19 illustrates steps of an alternate method in accordance with the present invention. In step 200 an electro-mechanical core for a hearing aid, surrounded by a foam matrix which could be configured from the standardized component parts previously discussed in connection with FIG. 16, is provided. In step 202 the core is coated with an elastomeric layer.

Coating can be accomplished a variety of ways including dipping, illustrated, spraying or by any other method whereby a substantially constant thickness layer of elastomeric material is applied to the foam of the core. When the elastomeric layer is cured, the respective unit will be ready for insertion into a users ear canal. The method of FIG. 19 will rapidly and inexpensively provide a thin elastomeric outer layer around the compressible foam.

FIGS. 20A–20D illustrate several views of a deformable, soft shell 12' with an internally located spine 12'-1. The spine 12'-1 can be hollow, functioning as a vent tube, or solid. It can be integrally molded into an interior region 12'-2 of shell 12', or attached to the shell 12' by adhesive, heat, or ultrasonic or RF-type welding. Alternately, a plurality of spines, corresponding to spine 12'-1, can be incorporated into soft shell 12'.

Figure 20A:
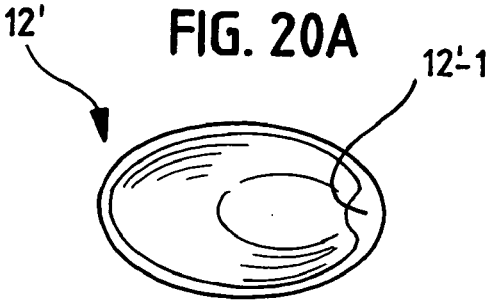
FIGS. 20A–20D illustrate alternate views of another embodiment of the invention.
Figure 20B:
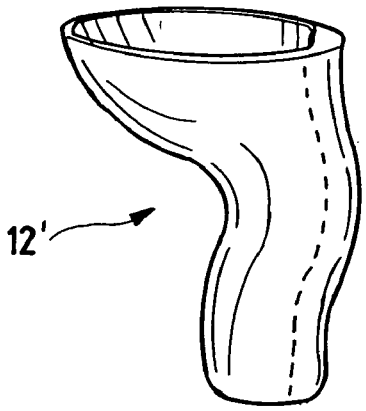
Figure 20C:
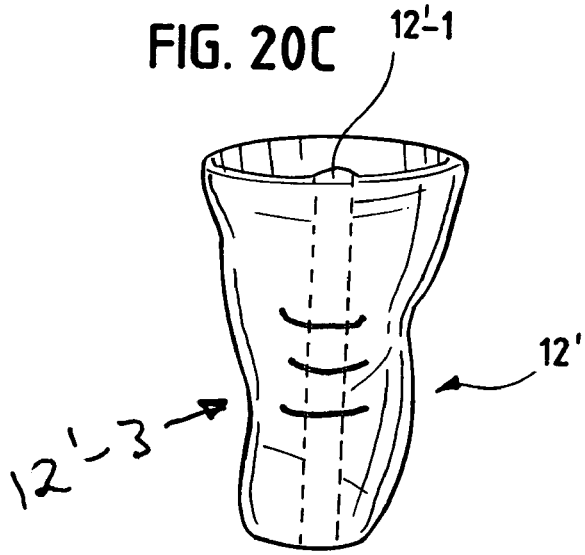
Figure 20D:
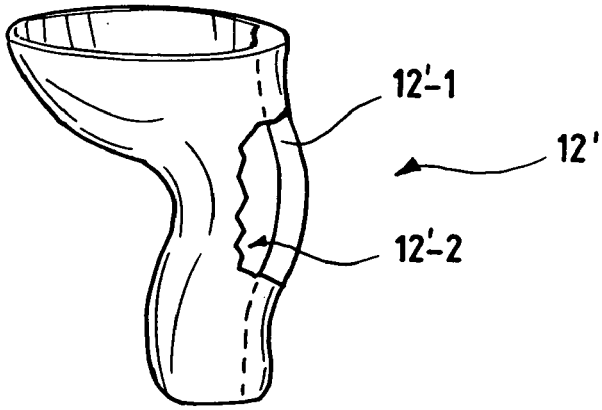

As illustrated in FIG. 20C, the deformable, soft shell 12' can carry a plurality of integrally molded, relatively short, outwardly oriented ribs indicated generally at 12'-3 on an exterior periphery thereof. These ribs, after insertion, directly contact the periphery of the ear canal. They tend to attenuate acoustic energy which is internally generated and is radiating outward toward the ear canal. This reduces feedback enabling the respective hearing aid to be operated at a higher gain than previously possible.

From the foregoing, it will be observed that numerous variations and modifications may be effected without departing from the spirit and scope of the invention. It is to be understood that no limitation with respect to the specific apparatus illustrated herein is intended or should be inferred. It is intended to cover by the appended claims all such modifications as fall within the scope of the claims.

What is claimed is:

1. A hearing aid comprising:

a deformable skin which bounds an internal region and wherein the skin does not exhibit sufficient rigidity to be insertable into a user's ear canal;

at least one spine which extends axially along an interior surface of the skin and is attached thereto sufficiently so as to provide insertion rigidity when the skin is inserted into the user's ear canal and which includes a deformable matrix in the region wherein the matrix applies expansive forces to the skin.

2. A hearing aid as in claim 1 wherein the skin is formed of an elastomer selected from a class which includes silicone, polyurethane, latex, and polyvinyl-chloride.

3. A hearing aid as in claim 1 which includes an output transducer wherein the skin and spine, but not the output transducer, are distorted on insertion into the ear canal.

4. A hearing aid as in claim 1 wherein the matrix is compressible in response to forces applied by the ear canal whereby a volume parameter of the internal region is dynamically alterable in response to applied ear canal forces.

5. A hearing aid as in claim 4 wherein the expansive forces contribute to the skin forming a seal with the user's ear canal, wherein as the shape of the ear canal changes, due to movement of the user's jaw, the seal is broken, permitting air flow into the canal, and reforms as the matrix continues to apply expansive forces to the skin.

6. A hearing aid as in claim 4 which includes a faceplate attached to the skin.

7. A hearing aid as in claim 1 wherein the expansive forces contribute to the skin forming a seal with the user's ear canal, wherein as the shape of the ear canal changes, due to movement of the user's jaw, the seal is broken, permitting air flow into the canal, and reforms as the matrix continues to apply expansive forces to the skin.

8. A hearing aid comprising:

a deformable skin which bounds an internal region wherein the skin does not exhibit sufficient rigidity to be insertable into a user's ear canal; and at least one spine which extends axially along an interior surface of the skin and is attached thereto sufficiently so as to provide insertion rigidity when the skin is inserted into the user's ear canal and wherein the spine comprises a vent tube that is attached to the skin substantially along its length.

9. A hearing aid comprising:

a deformable skin which bounds an internal region wherein the skin does not exhibit sufficient rigidity to be insertable into a user's ear canal; and at least one spine which extends axially along an interior surface of the skin and is attached thereto sufficiently so as to provide insertion rigidity when the skin is inserted into the user's ear canal and wherein the at least one spine is integrally molded with the skin.

10. A hearing aid as in claim 9 which includes a plurality of ribs formed on an exterior periphery of the skin.

11. A hearing aid comprising:

a deformable skin which bounds an internal region wherein the skin does not exhibit sufficient rigidity to be insertable into a user's ear canal; and at least one spine which extends axially along an interior surface of the skin and is attached thereto sufficiently so as to provide insertion rigidity when the skin is inserted into the user's ear canal and which includes an audio output transducer in the internal region wherein the transducer is surrounded, at least in part, by a compressible matrix.

12. A hearing aid as in claim 11 wherein the matrix pre-loads the skin with outwardly directed expansive forces.

13. A hearing aid as in claim 11 wherein the matrix comprises at least one of an open cell foam, a closed cell foam, and a fabric.

14. A hearing aid comprising:

a deformable skin which bounds an internal region and where the skin is compliant and at least one spine which extends axially along an interior surface of the skin and is attached thereto sufficiently so as to provide insertion rigidity when the skin is inserted into the user's ear canal and which includes a deformable matrix in the region wherein the matrix applies expansive forces to the skin.

15. A hearing aid as in claim 14 wherein the skin is formed of an elastomer selected from a class which includes silicone, polyurethane, latex, and polyvinyl-chloride.

16. A hearing aid as in claim 14 which includes an output transducer wherein the skin and spine, but not the output transducer, are distorted on insertion into the ear canal.

17. A hearing aid as in claim 14 wherein the matrix is compressible in response to forces applied by the ear canal whereby a volume parameter of the internal region is dynamically alterable in response to applied ear canal forces.

18. A hearing aid as in claim 17 wherein the expansive forces contribute to the skin forming a seal with the user's ear canal, wherein as the shape of the ear canal changes, due to movement of the user's jaw, the seal is broken, permitting air flow into the canal, and reforms as the matrix continues to apply expansive forces to the skin.

19. A hearing aid as in claim 17 which includes a faceplate attached to the skin.

20. A hearing aid as in claim 14 wherein the expansive forces contribute to the skin forming a seal with the user's ear canal, wherein as the shape of the ear canal changes, due to movement of the user's jaw, the seal is broken, permitting air flow into the canal, and reforms as the matrix continues to apply expansive forces to the skin.

21. A hearing aid comprising:

a deformable skin which bounds an internal region where the skin is compliant and at least one spine which extends axially along an interior surface of the skin and is attached thereto sufficiently so as to provide insertion rinidity when the skin is inserted into the user's ear canal and wherein the spine comprises a vent tube that is attached to the skin substantially along its length.

22. A hearing aid comprising:

a deformable skin which bounds an internal region where the skin is compliant and at least one spine which extends axially alone an interior surface of the skin and is attached thereto sufficiently so as to provide insertion rigidity when the skin is inserted into the user's ear canal and wherein the at least one spine is integrally molded with the skin.

23. A hearing aid as in claim 22 which includes a plurality of ribs formed on an exterior periphery of the skin.

24. A hearing aid comprising:

a deformable skin which bounds an internal region where the skin is compliant and at least one sDine which extends axially alone an interior surface of the skin and is attached thereto sufficiently so as to provide insertion rigidity when the skin is inserted into the user's ear canal and which includes an audio output transducer in the internal region wherein the transducer is surrounded, at least in part, by a compressible matrix.

25. A hearing aid as in claim 24 wherein the matrix pre-loads the skin with outwardly directed expansive forces.

26. A hearing aid as in claim 24 wherein the matrix comprises at least one of an open cell foam, a closed cell foam, and a fabric.

* * * * *